United States Patent [19]

Larsen

[11] Patent Number: 4,833,759

[45] **Date of Patent: * May 30, 1989**

[54] BIFURCATED MEMBER HOOK FASTENING DEVICE

[76] Inventor: Walter Louis Larsen, P.O. Box 18302, Seattle, Wash. 98118

[ * ] Notice: The portion of the term of this patent subsequent to Nov. 19, 2002 has been disclaimed.

[21] Appl. No.: 102,082

[22] PCT Filed: Nov. 8, 1985

[86] PCT No.: PCT/US85/02224

§ 371 Date: Jul. 8, 1987

§ 102(e) Date: Jul. 8, 1987

[87] PCT Pub. No.: WO87/02871

PCT Pub. Date: May 21, 1987

[51] Int. Cl.[4] ..... A41D 27/22; A44B 13/02

[52] U.S. Cl. ..... 24/489; 24/505; 24/509; 24/536; 223/85

[58] Field of Search ..... 24/489, 509, 546, 536, 24/505, 562; 248/317; 223/85; 211/119.12

[56] References Cited

U.S. PATENT DOCUMENTS

| | | | |
|---|---|---|---|
| 135,882 | 2/1873 | Bonney . | |
| 341,856 | 5/1886 | Proctor | 223/85 |
| 485,758 | 11/1892 | Delug . | |
| 590,401 | 9/1897 | Morgan | 24/562 |
| 733,921 | 7/1903 | Sibley . | |
| 1,273,809 | 6/1918 | Beazell . | |
| 1,690,614 | 11/1928 | Bower . | |
| 2,260,560 | 10/1941 | Coleman | 211/119.12 |
| 2,474,429 | 6/1949 | Kreitmayr . | |
| 2,542,224 | 2/1951 | Werner | 24/536 |
| 2,607,096 | 8/1952 | Sousa | 24/546 |
| 2,947,052 | 8/1960 | Michalsky | 24/546 |
| 3,202,329 | 8/1965 | Schmidt . | |
| 3,240,462 | 3/1966 | Schneider . | |
| 4,139,174 | 2/1979 | Olson | 248/317 |

FOREIGN PATENT DOCUMENTS

| | | |
|---|---|---|
| 73678 | 1/1952 | Denmark . |
| 118789 | 2/1970 | Norway . |

*Primary Examiner*—Victor N. Sakran

[57] ABSTRACT

This invention provides solutions to the problem of fastening a hook (53), such as a garment hanger hook (53), directly to a linear member (7), such as a clothesline (7), to which the hook (53) is hooked in the normal manner. This is accomplished by a discrete openable clasp (64–73, 77) having two jawed fastening members (64, 72), at least one fastening member (64) being bifurcated for accommodating the hook (53) within its two spaced-apart branches (65) so that it can straddle and reach past the hook (53) to clasp the linear member (7), the two fastening members (64, 72) being arranged for conjointly clasping the hook (53) and the linear member (7) together. Most embodiments of the clasp can also fasten two generally linear members (7) together in a crossing relationship. In general, an object can be indirectly fastened to a linear member (7) by being connected to a hook (53) which is fastened to a linear member (7) by the openable clasp (64–73, 77).

96 Claims, 5 Drawing Sheets

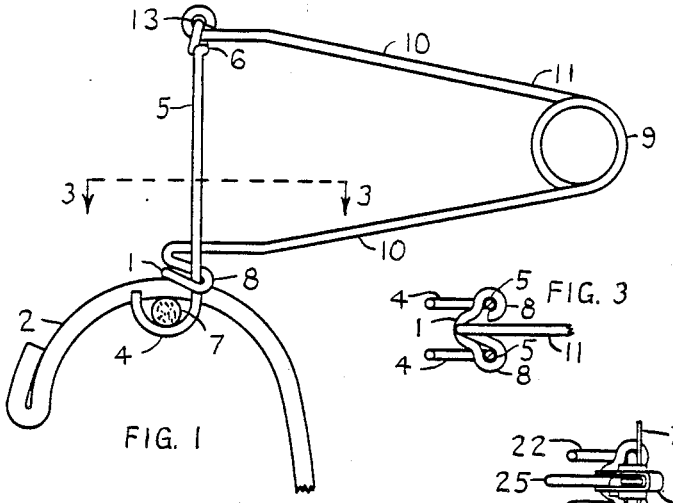
FIG. 1
FIG. 3
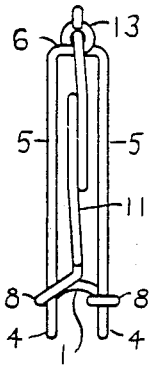
FIG. 2
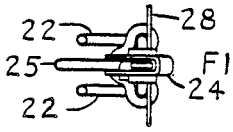
FIG. 7
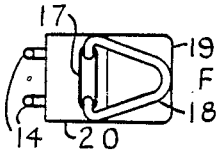
FIG. 4
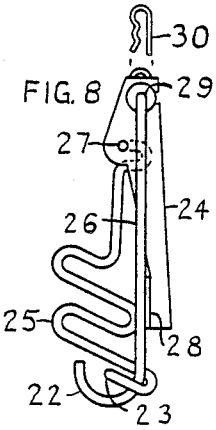
FIG. 8
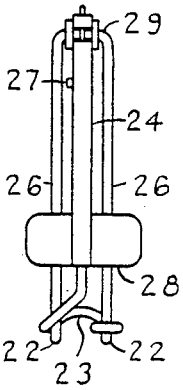
FIG. 9
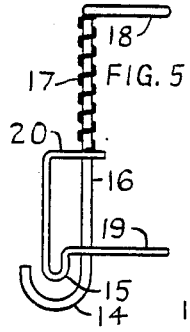
FIG. 5
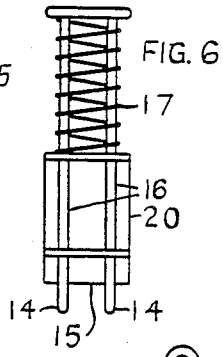
FIG. 6
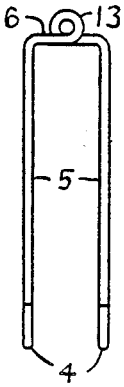
FIG. 11
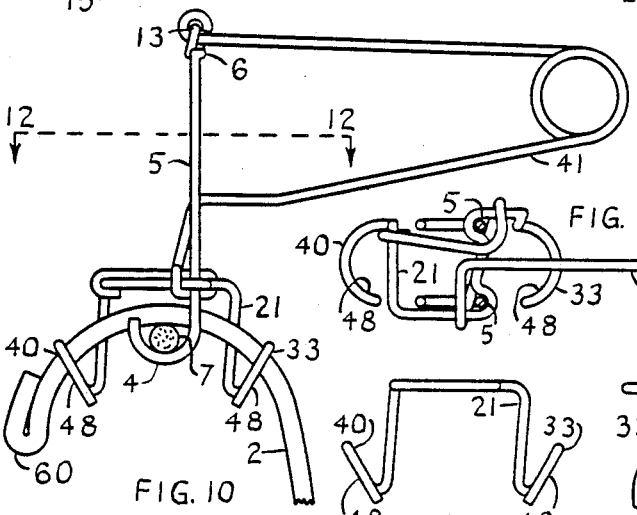
FIG. 10
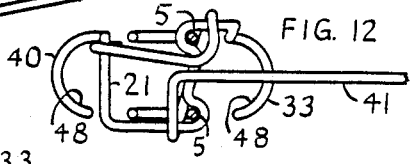
FIG. 12
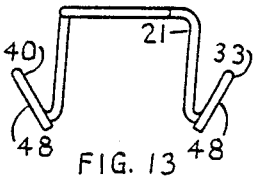
FIG. 13
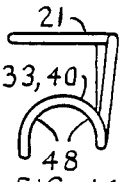
FIG. 14

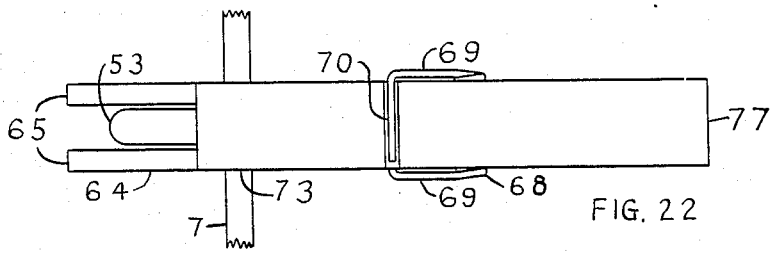
FIG. 22
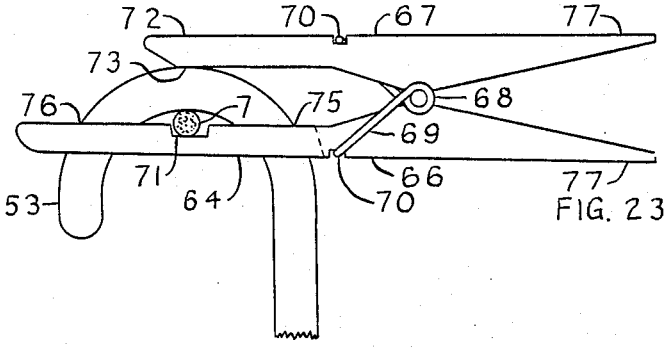
FIG. 23
FIG. 24
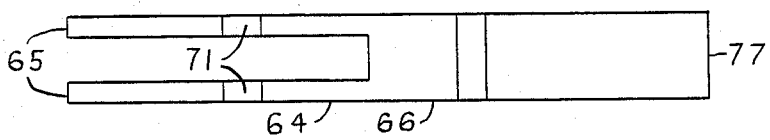
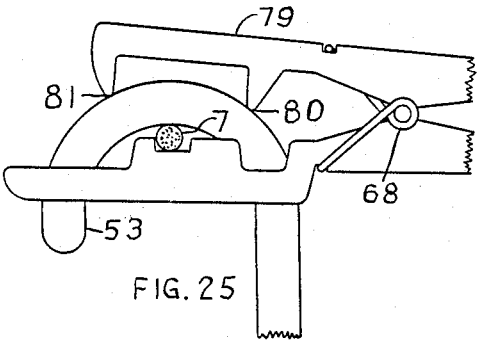
FIG. 25
FIG. 27
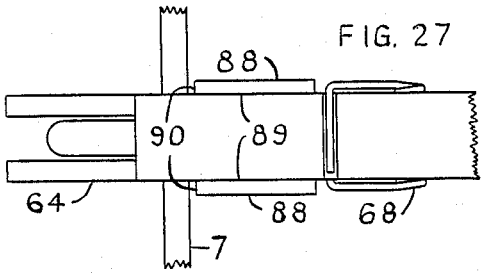
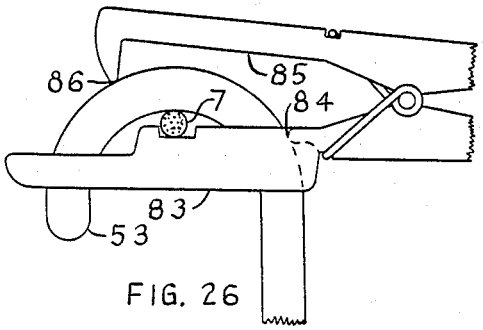
FIG. 26
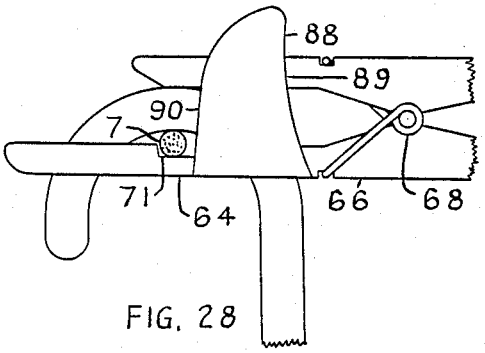
FIG. 28

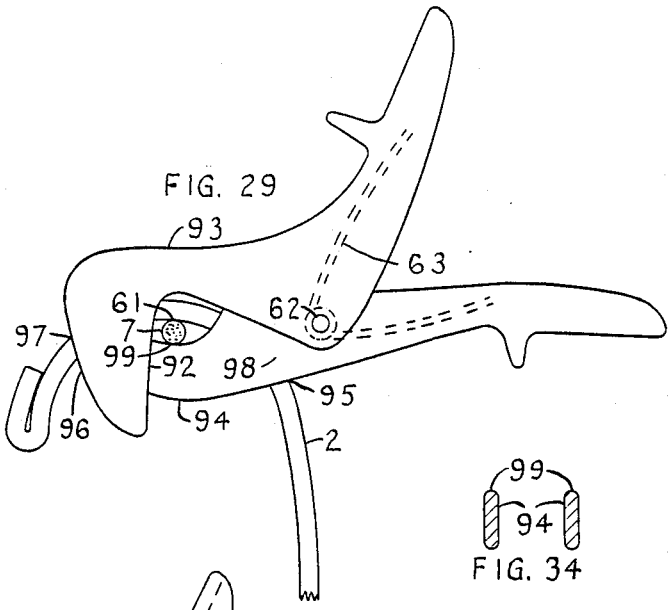
FIG. 29
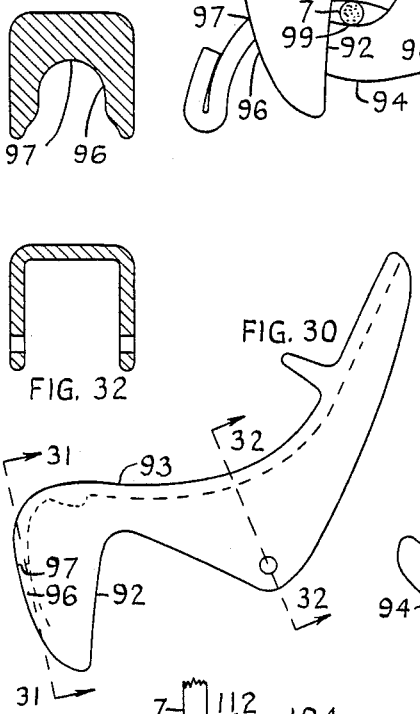
FIG. 30
FIG. 31
FIG. 32
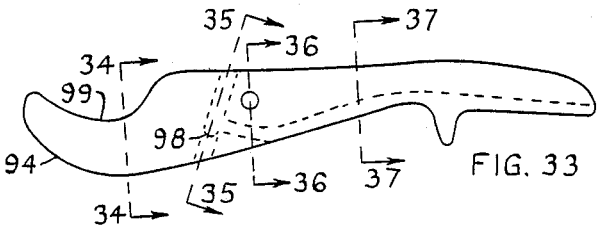
FIG. 33
FIG. 34
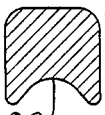
FIG. 35
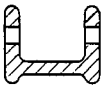
FIG. 36
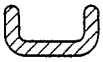
FIG. 37
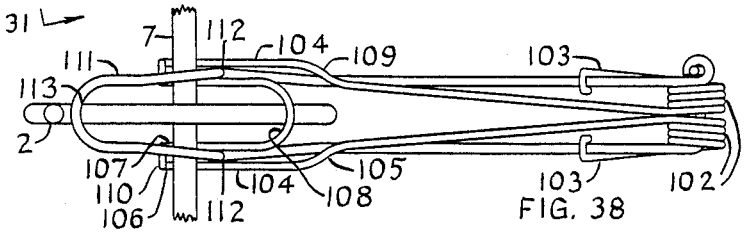
FIG. 38
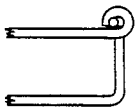
FIG. 40
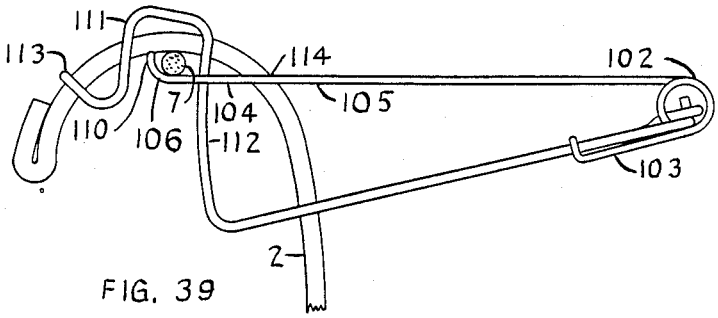
FIG. 39
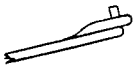
FIG. 41

BIFURCATED MEMBER HOOK FASTENING DEVICE

CROSS REFERENCE TO RELATED APPLICATIONS

This application contains subject matter presented in U.S. Application No. 028,850, filing date Apr. 10, 1979; in U.S. Application No. 246,067, filing date Mar. 20, 1981; in U.S. Application No. 373,121, filing date Apr. 29, 1982; and in International Application No. PCT/US85/02224, international filing date Nov. 08, 1985.

U.S. Application No. 028,850 issued as U.S. Pat. No. 4,575,906 on Mar. 18, 1986 and Application No. 246,067 issued as U.S. Pat. No. 4,553,294 on Nov. 19, 1985.

TECHNICAL FIELD

This invention relates to clasping devices, having a bifurcated fastening member, adapted for fastening the hook of a garment hanger or other hook including device to a linear member such as a clothesline, cable, rod or the like to which the hook is hooked in the normal manner. Such clasping devices are generally also adapted for fastening two crossing linear members together. The invention further relates to devices, comprised of a hook and a clasping device, for connecting an object to a linear member. It also relates to methods for fastening a hook to a linear member, for fastening two crossing linear members together, for connecting an object to a linear member, and for making devices to accomplish these purposes.

BACKGROUND ART

French Pat. No. 1.500.741 presents a resiliently bendable loop fastening device which functions to fasten the hook of a garment hanger directly to a clothesline and which operates in an entirely different manner from that of the devices set forth herein. Danish Patent No. 73678 presents a spring clip device which is installed on the inside area of a garment hanger hook to fasten the hook to a linear member. Norwegian Patent No. 118789 shows devices resembling peg-type clothespins which are used to frictionally restrain a garment hanger hook in its position on a clothesline or, alternatively, to suspend the hook below the clothesline. U.S. Pat. No. 1,273,809 shows a wire clamp having some similarities to certain embodiments of the clasping devices set forth herein. U.S. Pat. No. 2,474,429 combines a generally L-shaped bracket with a closely matched garment hanger hook to provide means for closing the opening of the hook, but which is not realistically capable of forcefully clamping the hook to a supporting linear member. U.S. Pat. No. 3,202,329 shows a highly modified garment hanger hook having an elongated slot at its upper section to receive a clothesline and a specially modified clothespin to clamp across and to close the opening of the slot in order to retain the clothesline in the slot. U.S. Pat. Nos. 1,690,614 and 3,048,311 present highly modified garment hanger hooks which include means for locking the hook to a supporting clothesline. U.S. Pat. No. 3,240,462 presents a clamping device which replaces the hook of a garment hanger and which provides means for positively clamping the garment hanger to a clothesline. U.S. Pat. Nos. 2,915,274 and 3,184,204 show devices which can be suspended from a clothesline and which, in turn, have means for suspending a garment hanger hook from the device itself. U.S. Pat. Nos. 135,882; 485,758; 733,921; and 2,542,224 show devices which bear some resemblance to certain embodiments of the clasp presented herein.

DISCLOSURE OF THE INVENTION

There has long been a need for a practicable fastening device which could fasten a garment hanger or other hook including device to a clothesline or other linear member. In the case of garment hangers, they are commonly used for holding various articles of clothing while they dry after being laundered. When suspended from a clothesline, garment hangers are often blown by the wind along the clothesline, particularly when the clothesline has appreciable sag, with the result that several suspended garment hangers may bunch together and thereby retard the drying. In gusty winds, suspended garment hangers are often blown off the clothesline.

Some of the previous attempts to solve these problems have involved modifications to, or replacement of, the hook of the garment hanger. In some cases this has resulted in devices which were very limited in the range of diameters of supporting clotheslines which could be accomodated. Nearly always, such devices resulted in higher product cost. Such devices also lacked convenience and flexibility since they could only be used with the particular garment hanger on which they were installed. Other devices have been made which merely close the opening of a garment hanger hook without any capability for frictionally fastening the hook to a clothesline so as to prevent displacement of the hook along the clothesline. Other attempts at solving these problems have produced devices which attach to the clothesline and then, in turn, suspend the garment hanger hook from the device itself. These devices appear to be costly and/or ineffectual at retaining the hook in suspension under adverse conditions. The bendable loop set forth in French Pat. No. 1.500.741 is a separate fastening device which does fasten a hook to a clothesline. However, this device is quite limited in the range of hook and clothesline sizes which it can accommodate and is also limited in the amount of clamping force which it can exert on the hook and the clothesline.

In order to alleviate problems such as the foregoing, this invention provides a resiliently biased openable clasp having at least one bifurcated fastening member arranged so that that fastening member can straddle and reach past both sides of a suspended garment hanger hook or other type of hook and clasp to the supporting linear member, while a second fastening member clasps the hook and the linear member together in conjunction with the clasping action of the first fastening member. Most embodiments of the openable clasp are also capable of fastening two generally linear members together in a crossing relationship by functioning in substantially the same manner as when fastening a hook to a linear member, merely by substituting a second linear member for the hook. The openable clasp may be provided with an overcenter locking lever which can be manipulated to open, close, and lock the clasp in the closed position. The openable clasp can be combined with a hook to form a device which is generally capable of fastening an object to a linear member. In this case the object is attached to the hook, generally to the shank portion of the hook, by any appropriate means and the hook is, in turn, fastened to the linear member by means of the openable clasp.

It is therefore an object of the present invention to provide a discrete openable clasp for securing the hook of a garment hanger or other hook or similarly curved member including device to a clothesline or other generally linear member to which the hook is attached by being hooked to the linear member.

It is also an object of this invention to provide a clasp for fastening two generally linear members together in a generally closing relationship.

Another object of the invention is to provide an openable clasp for fastening a hook to a linear member or for fastening two generally linear members together which is inexpensive to manufacture and easy to use and which will tend to prevent the two members being fastened together from being unintentionally separated from each other as well as from being displaced from their desired fastening position.

A further object of this invention is to provide a device, comprised of the combination of a hook and a discrete openable clasp, for generally fastening an object to a linear member.

A still further object of this invention is to provide methods for fastening a hook to a linear member, for fastening an object to a linear member, for fastening two generally linear members together, and for providing for the fastening stability of a clasp used in accomplishing these methods.

Other objects and advantages will become apparent and a fuller understanding of the invention may be had by referring to the detailed description hereinafter presented, taken in conjunction with the drawings forming a part hereof, wherein like numerals refer to like parts throughout.

BRIEF DESCRIPTION OF THE DRAWINGS

FIG. 1 is a side elevational view of the openable clasp having a pair of spaced-apart coacting fastening hooks for the bifurcated fastening member and a two-legged spring for the resilient closing member, shown fastening a garment hanger hook to a clothesline.

FIG. 2 is an end view of the openable clasp shown in FIG. 1 without the garment hanger hook and the clothesline.

FIG. 3 is a fragmentary sectional plan view at the plain indicated by the line 3—3 of FIG. 1 without the garment hanger hook and clothesline.

FIG. 4 is a plan view of the openable clasp with coacting fastening hooks having a helical type spring for the resilient closing member.

FIG. 5 is a side elevational view of the device shown in FIG. 4.

FIG. 6 is an end view of the device shown in FIGS. 4 and 5.

FIG. 7 is a plan view of the openable clasp with coacting fastening hooks, incorporating an overcenter locking lever.

FIG. 8 is a side elevational view of the device shown in FIG. 7, a clip for pivotally locking the locking lever to the structure connecting the two coactig fastening hooks together being depicted above the principal figure.

FIG. 9 is an end view of the device shown in FIGS. 7 and 8.

FIG. 10 is a side elevational view of the openable clasp with coacting fastening hooks having a two-legged spring and an opposing clamping member made of metal wire which contacts the garment hanger hook at two separated locations, shown fastening a garment hanger hook to a clothesline.

FIG. 11 is an end view, taken from the left, of the pair of coacting fastening hooks and their connecting structure, from the device shown in FIG. 10.

FIG. 12 is a fragmentary sectional plan view of the openable clasp, taken at the plane indicated by the line 12—12 of FIG. 10, shown without the garment hanger hook and clothesline.

FIG. 13 is a side elevational view of the opposing clamping member of the device shown in FIGS. 10 and 12 or 15.

FIG. 14 is an end view of the opposing clamping member shown in FIG. 13.

FIG. 22 is a plan view of the openable clasp comprised of two lever members connected for hinged-type angular relative movement having a bifurcated fastening member positioned in a radial orientation and a second fastening member without a bifurcation, shown fastening a garment hanger hook to a clothesline.

FIG. 23 is a side elevational view of the openable clasp shown in FIG. 22

FIG. 24 is a plan view of the lever member combined with the bifurcated fastening member, being part of the device shown in FIGS. 22 and 23 and shown without the garment hanger hook and the clothesline.

FIG. 25 is a fragmentary side elevational view of the two-lever-member openable clasp configured basically similar to the device shown in FIGS. 22–24, wherein the second fastening member has jaw elements shaped and positioned for contacting the outer surface of the hook in two separated locations, shown fastening a garment hanger hook to a clothesline.

FIG. 26 is a fragmentary side elevational view of the two-lever-member openable clasp configured basically similar to the devices shown in FIGS. 22–24, wherein the bifurcated fastening member is arranged for contactig the outer surface of the hook at the inboard end of the bifurcation and wherein the second fastening member has a jaw element positioned for contacting the outer surface of the hook at a location outboard of the clothesline, shown fastening a garment hanger hook to a clothesline.

FIG. 27 is a fragmentary plan view of the two-lever-member openable clasp similar to the device shown in FIGS. 22-24, wherein the bifurcated fastening member has guide and linear member retaining structure, shown fastening a garment hanger hook to a clothesline.

FIG. 28 is a fragmentary side elevational view of the device shown in FIG. 27.

FIG. 29 is a side elevational view of the two-lever-member openable clasp wherein the second fastening member has a lateral confinement element for the hook and linear member retaining structure outboard of the position occupied by the clothesline, shown fastening a garment hanger hook to a clothesline.

FIG. 30 is a side elevational view of the lever member combined with the second fastening member, being part of the device shown in FIG. 29.

FIG. 31 is a view of the section at the plane indicated by the line 31—31 of FIG. 30.

FIG. 32 is a view of the section at the plane indicated by the line 32—32 of FIG. 30.

FIG. 33 is a side elevational view of the lever member combined with the bifurcated fastening member, being part of the device shown in FIG. 29.

FIG. 34 is a view of the section at the plane indicated by the line 34—34 of FIG. 33

FIG. 35 is a view of the section at the plane indicated by the line 35—35 of FIG. 33.

FIG. 36 is a view of the section at the plane indicated by the line 36—36 of FIG. 33.

FIG. 37 is a view of the section at the plane indicated by the line 37—37 of FIG. 33.

FIG. 38 is a plan view of the two-lever-member openable clasp made of two sections of wire wherein the bifurcated fastening member has linear member retaining structure outboard, and the second fastening member has linear member retaining structure inboard of the position occupied by the clothesline, shown fastening a garment hanger hook to a clothesline.

FIG. 39 is a side elevational view of the device shown in FIG. 38.

FIG. 40 is a fragmentary plan view of the pivot end of the lever member having the second fastening member, being part of the device shown in FIGS. 38 and 39.

FIG. 41 is a fragmentary side elevational view of that portion of the device shown in FIG. 40.

MODES FOR CARRYING OUT THE INVENTION

Figure 16:
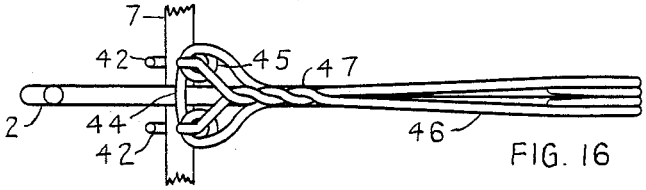
FIG. 16 is a plan view of the openable clasp with coacting fastening hooks configured to operate similar to the device shown in FIGS. 1–3, wherein the clasp is made of a single piece of metal wire, shown fastening a garment hanger hook to a clothesline.

The basic concept of this invention is to provide a resiliently biased openable clasp having two fastening members which act together to clasp a hook, such as a garment hanger hook, directly to a supporting linear member such as a clothesline. At least one of the fastening members is bifurcated with two spaced-apart branches which are arranged to accomodate a section of the hook within the space between the branches so that the bifurcated fastening member can straddle and reach past the hook to clasp the supporting linear member, while the second fastening member clasps the hook and the linear member together in conjunction with the clasping action of the bifurcated fastening member.

FIGS. 1 through 3 depict one embodiment of this openable clasp in which the bifurcated fastening member is comprised of a pair of spaced-apart coacting fastening hooks, 4, which are arranged to straddle and reach past the garment hanger hook, 2, on coacting fastening hook on each side of the garment hanger hook, and to hook to and pull up on the clothesline, 7, or other supporting linear member. The second fastening member is an opposing clamping member, 1, which is arranged to contact and bear down on the outer surface of the garment hanger hook, 2, in opposition to the pulling action of the coacting fastening hooks, 4, on the clothesline, 7, with the result that the garment hanger hook and the clothesline are positively and frictionally clasped together. The two coacting fastening hooks, 4, are connected together in this embodiment by a hook connecting structure, 6, located at the top of the shanks, 5, of the hooks which causes both of the hooks to move and act together.

The two fastening members (the pair of coacting fastening hooks and the opposing clamping member), 4 and 1, are connected together by relative movement connecting structure so as to provide for limited opening-and-closing movement of the two fastening members with respect to each other, and there is also a resilient closing member in the form of a two-legged spring, 11, to urge the two fastening members toward a generally closed position. The opposing clamping member, 1, is arranged with a loop, 8, around each shank, 5, of the coacting fastening hooks, 4, to form a slidable connection with those hooks for the opening and closing movement of the two fastening members with respect to each other. A pivotal connection, 13, is provided between the hook connecting structure, 6, and the spring, 11. The spring, 11, which may have one or more coils, 9, in its center section to increase its flexibility and range of extension, has two legs, 10, which are arranged so that the openable clasp can be opened by squeezing the legs, 10, together with the fingers.

The relative movement connecting structure in this particular embodiment includes the sliding connection of the opposing clamping member, 1, along the shanks, 5, of the coacting fastening hooks, it includes the two-legged spring, 11, and it also includes the pivotal connection, 13, between the spring and the hook connecting structure, 6. Thus it is clear that what is being included in the definition of the term "relative movement connecting structure", is every part of the structure of the clasp which accomplishes the connection which provides for the opening-and-closing relative movement between the two fastening member, and this may include structure which is also included in other specific parts of the clasp such as the shanks, 5, of the coacting fastening hooks, the hook connecting structure, 6, the two-legged spring, 11, and the pivotal connection, 13, between the spring and the hook connecting structure.

The term "fastening member", on the other hand, is restricted in its meaning to include only that portion of the structure of the openable clasp which accomplishes the fastening action of the clasp. In this embodiment, the bifurcated fastening member, with its two generally parallel spaced-apart branches, is comprised only of the two coacting fastening hooks which include the hooked parts, 4, and the shanks, 5, of the hooks. Ordinarily, these two coacting fastening hooks are quite directly connected together, as they are, in this particular embodiment, by the hook connecting structure, 6. Thus, ordinarily, the concept of a bifurcation in the fastening member will directly apply to embodiments of this invention. However, instead of having such a direct connection between the two coacting fastening hooks or branches of the bifurcated fastening member, it would be possible to have them only indirectly connected together as would be the case, for example, if they were connected through the structure of other members of the openable clasp. The term "fastening member" or "bifurcated fastening member" is taken herein to mean and apply to the situation in which the parts or branches of such fastening member are quite directly connected together, as in the embodiment of FIGS. 1–3, as well as the functionally equivalent situation in which the connection between such parts or branches is only indirect.

In the embodiment of FIGS. 1–3, the connection between the two coacting fastening hooks, 4, by the hook connecting structure, 6, is positioned at the top of the shanks of the hooks to provide adequate clearance between the hook connecting structure, 6, and the garment hanger hook, 2, during installation of the clasp in its fastening position. This connectoin between the coacting fastening hooks is also sufficiently sturdy in its construction and connection with the two hooks to maintain an approximately fixed relative position of the two coacting fastening hooks with respect to each other throughout the normal range of operation of the openable clasp. It would, however, be possible for the openable clasp to function if these two branches of the bifurcated fastening member (the two coacting fastening hooks) were connected together only flexibly as could be possible with an indirect connection between them. The terms "connected", "connected together", "connecting", "connection", etc., as used herein to describe a non-hinged, non-sliding, or other generally non movable juncture between named parts of the openable clasp are taken to mean both a union in which the parts share and are made of the same continuous piece of material, and also a fixed mechanical connection between separate and discontinuous pieces of material.

The second fastening member is comprised of the opposing clamping member, 1, including its jaw element (at 1) which contacts the outer surface of the garment hanger hook, 2, and the loops, 8, around each shank, 5, of the coacting fastening hooks which provide for the slidable connection with the shanks. The spring, 11, is not included as part of the opposing clamping member, 1, even though it is joined to it.

This clasp is used to fasten a garment hanger hook, 2, to a clothesline, 7, by pressing sections, 10, of the spring, 11, together with the hand to open the clasp and moving the extended coacting fastening hooks, 4, to straddle and reach past the garment hanger hook, 2, so that they hook to the clothesline, 7. Then the clasp is released so that the coacting fastening hooks, 4, pull up on the clothesline, 7, while the opposing clamping member, 1, bears down on the outer surface of the garment hanger hook, 2, due to the force of the spring, 11, thereby clamping the garment hanger hook and the clothesline together as shown in FIG. 1.

This clasp can also be used for fastening two generally linear members together in a crossing relationship in the same manner as it is used to fasten a hook to a linear member merely by substituting a second linear member for the hook. Actually, a hook can be considered to be a curved linear member which could be straightened out to represent a linear member which crosses the hook-supporting linear member.

The examples presented herein specifically involve the fastening of a garment hanger and its hook to a linear member such as a clothesline. Generally, an object, different than a garment hanger, can also be indirectly connected to a linear member by the methods and devices presented herein in a manner somewhat analogous to that performed by a snap hook. To accomplish this, the object can be temporarily or permanently attached to a hook, generally to the non hooked or shank portion of the hook, by means such as bolting, tying, welding, fastening with a snap fastener, by being manufactured as part of the same piece of material (as in the case of some garment hangers), etc. The exact means by which the object is attached to the hook is not pertinent to the inventive concept presented herein and any appropriate means for attaching the object to the hook is intended to be included within the scope of the claims presented herein. Also, the term "object", as used in the claims, includes a garment hanger as well as any other object which may be connected to a linear member. With the object attached to the hook, the hook can, in turn, be hooked to a linaer member and fastened to it by means of a clasp as described herein.

Other arrangements and types of springs may be used for constructing the openable clasp. FIGS. 4 through 6 shown an embodiment using a helical spring, 17, situated around and acting along the shanks, 16, of the coacting fastening hooks, 14. The structure, 20, which includes the opposing clamping member, 15, (here made of sheet metal) is arranged to slide along the shanks, 16, of the coacting fastening hooks for the opening and closing movement of the clasp. There are two finger rests, one, 18, on the hook connecting structure and the other, 19, on the structure, 20, which includes the opposing clamping member, 15, for manipulation of the clasp and for compressing the spring, 17, to open the clasp. In use, this clasp is handled and used in a manner very similar to that described for the device of FIGS. 1 through 3.

The openable clasp can be arranged so that it has an overcenter locking lever, 24, which opens and closes the clasp by actuating the sliding movement of the opposing clamping member, 23, along the shanks, 26, of the coacting fastening hooks, 22, and which also locks the clasp in its closed fastening position as depicted in FIGS. 7 through 9. In this embodiment, the resilient closing member is a spring, 25, which is pivotally connected to the overcenter locking lever, 24, at a first pivotal connection 27, for the overcenter locking lever. The spring, 25, is also connected to the opposing clamping member, 23. This spring, 25, acts as a link between the first pivotal connection, 27, on the overcenter locking lever and the opposing clamping member, 23, to allow the movement of the overcenter locking lever to open and close the clasp and the spring also allows the clasp to apply a sustained clamping force on the combination of the clothesline and the suspended garment hanger hook when the clasp is locked in its closed fastening position by the overcenter locking lever. The two coacting fastening hooks, 22, are structurally connected together at the top end of the hooks by a hook connecting structure, 29, which serves as a second pivotal connection for the overcenter locking lever, 24. A spring clip, 30, is used to pivotally lock the overcenter locking lever, 24, to the hook connecting structure, 29. The spring, 25, could be arranged differently than shown, or placed in alternative locations in the clasp. For example, the spring could be interposed between the hook connecting structure, 29, and the hooked part, 22, of each coacting fastening hook. This could be accomplished quite easily, for example, by bending the upper portion of each shank, 26, of each coacting fastening hook into the shape of a two-legged spring extending to the left as viewed in FIG. 8.

To use the openable clasp with the overcenter locking lever, the handle, 28, of the overcenter locking lever, 24, is grasped and swung in a counter clockwise direction about its pivotal connection with the hook connecting structure, 29, as viewed in FIG. 8. This action swings the pivotal connection, 27, for the spring around and up with the result that the spring, 25, is raised, in turn causing the opposing clamping member, 23, to which it is connected, to slide up the shanks, 26, of the coacting fastening hooks. With the clasp thus opened, it is lowered over the hook of a garment hanger which is suspended from a clothesline so that the two coacting fastening hooks, 22, straddle the garment hanger hook and hook to the clothesline in a manner similar to that shown in FIG. 1. Then the handle, 28, of the overcenter locking lever is swung back down in the opposite direction, thereby pushing the opposing clamping member, 23, down and in contact with the outer surface of the garment hanger hook, and finally locking the clasp in its fastening position as the overcenter locking lever, 24, reaches its overcenter locking position with the handle, 28, against the shanks, 26, of the coacting fastening hooks. FIG. 8 shows the openable clasp with the overcenter locking lever, 24, in its overcenter locking position without showing the garment hanger hook and the clothesline.

The openable clasp can be provided with an opposing clamping member which has two separated jaw elements so that the opposing clamping member will contact the outer surface of the garment hanger hook at two separated locations instead of contacting it at one location, as in the clasp shown in FIGS. 1–3. FIGS. 10 through 14 show an example of an openable clasp which operates in a manner similar to the device of FIGS. 1–3 except that its opposing clamping member, 21, has two separated jaw elements, 33 and 40, which causes it to contact the garment hanger hook, 2, at two separated locations, one inboard (at 33) and one outboard (at 40) of the position occupied by the clothesline, 7, as it is held by the two coactig fastening hooks, 4. The opposing clamping member, 21, is slidably connected to the shanks, 5, of the coacting fastening hooks, 4, This slidable connection causes the two jaw elements, 33 and 40, to remain effectively in the region between the two coacting fastening hooks, 4, (in the same region as that occupied by the garment hanger hook, 2) while the jaw elements are separated, one on each side of the position occupied by the clothesline. In common with the device of FIGS. 1 through 3, the device shown in FIG. 10 has a spring, 41, urging the opposing clamping member, 21, toward the hooked part, 4, of the coacting fastening hooks; the two coacting fastening hooks, 4, are united or connected together by a hook connecting structure, 6, at the top section of their shanks, 5; and there is a pivotal connection, 13, between the hook connecting structure, 6, and the spring, 41. The united bifurcated fastening member (the two coacting fastening hooks, 4, connected together by the hook connecting structure, 6), used in the openable clasp shown in FIG. 10, is shown by itself in FIG. 11. This bifurcated fastening member is of the same type as used in the clasp shown in FIGS. 1 through 3.

FIGS. 10 and 12 show details of the interlocking connection between the opposing clamping member, 21, the spring, 41, and the shanks, 5, of the coacting fastening hooks when these parts are made of wire. Additional details of the opposing clamping member, 21, are shown in FIGS. 13 and 14. FIGS. 10 and 12–14 show a lateral confinement element, 48, incorporated in the opposing clamping member, 21, at each location (33 and 40) where it contacts the garment hanger hook. These lateral confinement elements, 48, are generally shaped with concave surfaces so that they present lateral restraining surfaces which act to confine the garment hanger hook (or a second linear member when the clasp is used to fasten two linear members together) from being displaced sideways out of the jaw elements. Two effectively spaced-apart lateral confinement elements, as shown in FIG. 10, have a stabilizing effect tending to prevent the clasp from being laterally upset in its fastening position and, together, they constitute one form of a lateral hook containment structure which provides such stability by so confining the hook at two effectively spaced-apart locations where the hook passes through the lateral hook containment structure. A more complete explanation of a lateral hook containment structure is set forth herein in the description of the embodiments of FIGS. 19–21 and 22–24.

The use of an opposing clamping member with jaw elements which contact the outer surface of the garment hanger hook in two separated locations instead of one location has the effect of stabilizing the clasp in its fastening position by providing a force tending to prevent the clasp from slipping off the end of the garment hanger hook when used with hooks which do not have the bent-over end, 60, of the hook, 2, shown in FIG. 10, but which do have a straightened-out or less curved section at the end of the hook, as is characteristic of most garment hanger hooks. This stabilizing action occurs because, as the outboard jaw element, 40, moves closer to the end of the hook, the straightened-out portion causes the two fastening members to open wider against the force of the spring, 41, and the reaction to this is a force which urges the jaws in a direction away from the end of the hook.

Figure 15:
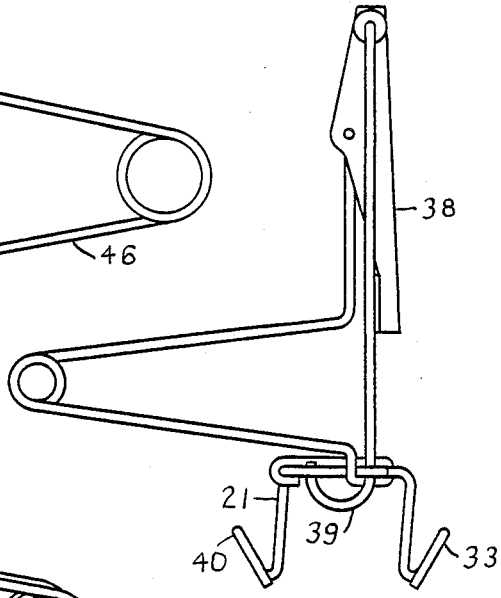
FIG. 15 is a side elevational view of the openable clasp with coacting fastening hooks incorporating an overcenter locking lever and having an opposing clamping member which contacts the garment hanger hook in two separated locations.

An openable clasp having an overcenter locking lever, 38, can be provided with an opposing clamping member, 21, having two jaw elements, 33 and 40, positioned for contacting the outer surface of the garment hanger hook in two separated locations as shown in FIG. 15. This clasp can also be provided with two effectively space-apart lateral confinement elements, at 33 and 40, as shown in that drawing. Here the overcenter locking lever, 38, and two coacting fastening hooks, 39, are similar to those elements of the clasp shown in FIGS. 7–9, while the opposing clamping member, 21, and the lateral hook containment structure, 33 and 40, which provides lateral stability for the clasp, is similar to that of the clasp shown in FIGS. 10 and 12–14.

Figure 17:
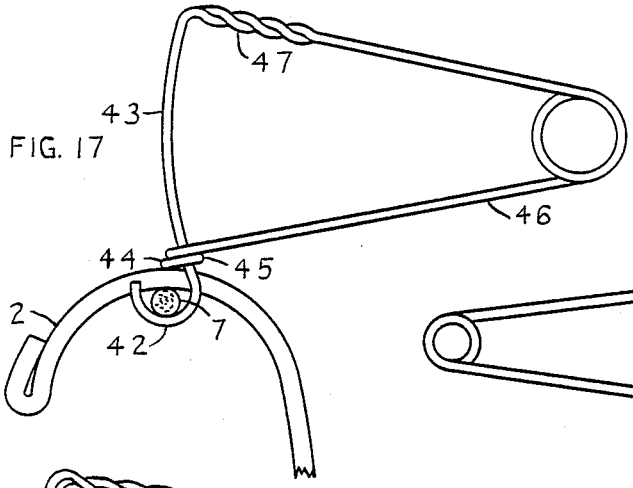
FIG. 17 is a side elevational view of the openable clasp shown in FIG. 16.
Figure 18:
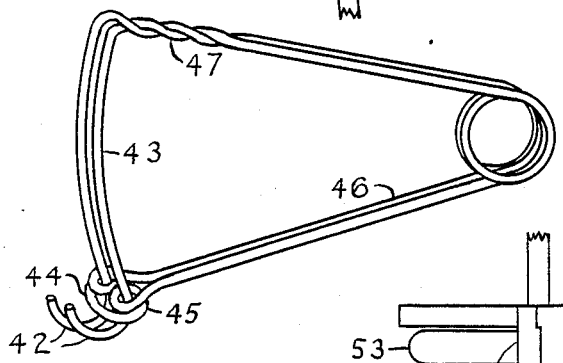
FIG. 18 is a perspective view of the openable clasp shown in FIGS. 16 and 17, without the garment hanger hook and the clothesline.

The openable clasp can be constructed of a single piece of material. An embodiment of a single-piece clasp, in which the bifurcated fastening member is in the form of a pair of coacting fastening hooks, is presented in FIGS. 16 through 18. This device is made of a single piece of wire in which each end of the wire is located at the end of each coacting fastening hook, 42. This clasp utilizes a two-legged spring, 46, which is doubled as is necessary with this particular construction. The opposing clamping member, 44, is at the approximate center of the length of wire and it has a loop, 45, around each shank, 43, of the coacting fastening hooks, 42, in order to stabilize the position and movement of the two fastening members with respect to each other. The shanks, 43, of the coacting fastening hooks, 42, are curved as shown in FIG. 17 in order that the opening and closing movement of the opposing clamping member with respect to the coacting fastening hooks will be approximately along the direction of curvature of the shanks, 43. This allows the opposing clamping member, 44, to slide back and forth along the shanks, 43, without binding. The sections of wire at the top end of the two-legged spring near the top of the coacting fastening hook shanks, at 47, are twisted together to act as a hook connecting structure in order to cause the two hooks to maintain an approximately fixed relative position with respect to each other throughout the normal range of operation of the clasp. It would, however, be possible to omit the twisting together of these sections of wire and still have the clasp function to fasten a garment hanger hook to a clothesline. In that case, the two coacting fastening hooks, 42, would be connected together only indirectly through other members of the clasp. This clasp functions to fasten a garment hanger hook, 2, to a clothesline, 7, in a manner very similar to that of the device shown in FIGS. 1 through 3.

Figure 19:
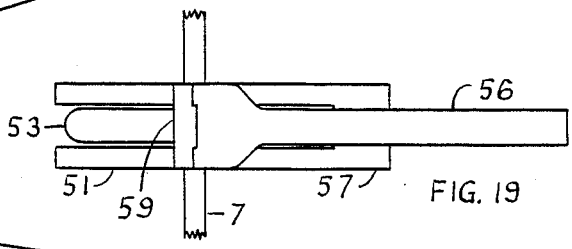
FIG. 19 is a plan view of the openable clasp with coacting fastening hooks combined with lateral hook containment structure, configured to operate similar to the devices shown in FIGS. 1–3 and 16–18, wherein the clasp is made of a single piece of sheet metal, shown fastening a garment hanger hook to a clothesline.
Figure 20:
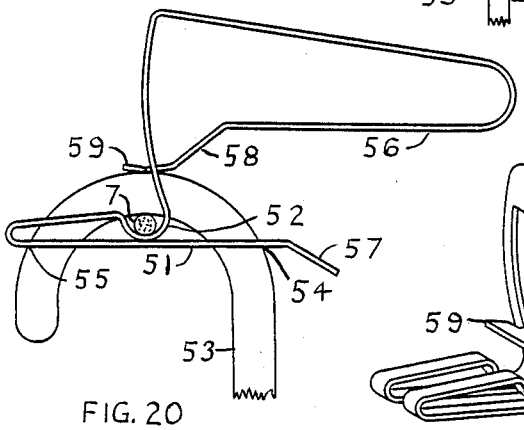
FIG. 20 is a side elevational view of the openable clasp shown in FIG. 19.
Figure 21:
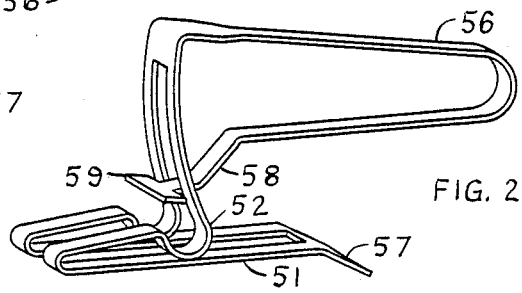
FIG. 21 is a perspective view of the openable clasp shown in FIGS. 19 and 20, without the garment hanger hook and clothesline, shown in a partly open position.

Another single-piece embodiment of the openable clasp is shown in FIGS. 19 through 21 and this clasp is made of sheet metal. The basic clasp portion of this device is similar to the one-piece wire clasp shown in FIGS. 16 through 18 and it, too, functions in a manner similar to the device shown in FIGS. 1 through 3. This clasp has a bifurcated fastening member which comprises not only the two coacting fastening hooks, 52, but also a lateral hook containment structure, 51, which is bifurcated and is connected to the coacting fastening hooks. This lateral hook containment structure, 51, is shaped and positioned so that it accommodates the garment hanger hook, 53, at two effectively spaced-apart locations, at 54 and 55, where the hook passes through the space between the two branches of the structure. One of these locations, 54, is inboard and the other location, 55, is outboard of the position occupied by the clothesline, 7, when the clasp is in its fastening position. This lateral hook containment structure, 51, gives the clasp very positive stability against being laterally upset in its fastening position on the hook and the clothesline and it makes it practically impossible for the clasp to be tipped upside down in its fastening position. As shown in FIG. 20, the two primary locations, at 54 and 55, where the hook passes through the lateral hook containment structure, 51, lie along a straight line which passes beneath the clothesline, 7, or other linear member. This straight line positioning provides an excellent design for the containment structure and it works well with different sizes and thicknesses of garment hanger hooks and clotheslines. There could be some variation, up or down, in the position of these two primary locations, 54 and 55, and the lateral hook containment structure would still function. However, if the containment structure was shaped so that the two primary locations where the hook, 53, passes through the structure were considerably higher and closer together, the stabilizing action of the structure could be considerably diminished or even rendered practically ineffective. The meaning of the phrase "effectively spaced-apart locations" in describing the primary locations where the hook passes through the lateral hook containment structure, is that these locations are so positioned and sufficiently spaced apart to give effective stability to the clasp against its being upset in its fastening position. This clasp could be manufactured by stamping a blank from sheet metal or other sheet material and then forming it into the shape shown. A cut-out in the blank provides for the bifurcation in the fastening member. The lateral hook containment structure, 51, could be eliminated and the clasp would function with its two coacting fastening hooks in the manner of the clasp shown in FIGS. 16–18. The two-legged spring, 56, is narrowed for proportioning spring forces. The opposing clamping member, 59, is somewhat flattened in the direction of a line lying in the plane of the garment hanger hook, 53, and tangent to the hook at the point where that member, 59, contacts the hook (in a direction substantially parallel to the longitudinal direction of the lateral hook containment structure, 51), and this provides considerably better stability to the clasp against rotation about an axis approximately coincidental with that of the clothesline, 7, than in the clasps shown in FIGS. 1–9 and 16–18. The reason for this is that, as the clasp rotates about that axis, the point of contact of the opposing clamping member, 59, with the garment hanger hook, 53, shifts in the direction of such rotation to provide a righting force in opposition to such rotation. FIG. 21 shows the clasp partly open.

FIGS. 22-24 show an embodiment of the clasp in which its two fastening members, 64 and 72, are combined with two lever members, 66 and 67, respectively, which are connected together so as to allow for generally hinged-type angular relative movement between them to provide for the opening-and closing movement of the two fastening members with respect to each other. Here the connection is provided by a coil-type spring, 68, which serves as the resilient closing member. This spring, 68, has a tangential extension, 69, at each end of the coil plus an additional right angle bend, 70, at the end of each tangential extension so that each terminal end of the wire of the spring is approximately parallel to the axis of the spring. As is evident from FIGS. 22 and 23, the spring is shaped and connected to the two lever members of the clasp in a manner similar to the common spring clothespin.

The bifurcated fastening member, 64, in this openable clasp is positioned in a primarily radial orientation in the clasp. This means that the two spaced-apart branches, 65, of that fastening member extend generally and approximately in a radial direction outward from the location, at 68, where the two lever members are, at least in effect, hingedly connected together. This radial orientation can be described as being with reference and respect to a circle centered on an axis which approximately coincides with the actual or effective axis of the hinged-type connection between the two lever members. The two branches, 65, of the bifurcated fastening member are separated from each other in a direction generally parallel to the axis of that circle so that that fastening member can straddle the hook to reach and apply clamping pressure to the clothesline, 7, or other linear member. Each branch, 65, of the bifurcated fastening member has a jaw element, 71, for contacting and applying such clamping pressure to the clothesline, 7, where it passes transversely through the jaw region of the clasp. As shown in FIG. 23, the clamping direction of these jaw elements on the clothesline is primarily circumferential with respect to the above defined circle. The term "jaw element" is herein taken to mean that portion or surface of the fastening member which is positioned and intended for contacting a linear member, hook, or other item being fastened by the openable clasp. A "jaw element" may or may not involve a separate piece of material from the rest of the fastening member.

The second fastening member, 72, in this openable clasp is combined with the second lever member, 67, and this fastening member does not have a radially oriented, or any other type of, bifurcation. This fastening member has a jaw element, 73, positioned for contacting the outer surface of the garment hanger hook, 53, in one general location, and for applying clamping pressure thereon in a direction in opposition to the clamping action of the bifurcated fastening member, 64, on the clothesline, 7, to forcefully and frictionally clamp the hook, 53, to the clothesline as shown in FIG. 23. The jaw element, 73, contacts the outer surface of the hook, 53, at a location approximately the same distance away from the hinge pivot, 68, as the location where the jaw elements, 71, of the bifurcated fastening member contact the clothesline, 7. This jaw element, 73, of the second fastening member (or opposing clamping member) is flattened in the direction of a line lying in the plane of the garment hanger hook, 53, and tangent to the hook at the point where the jaw element contacts the hook (in a direction substantially parallel to the longitudinal or radial direction of the bifurcated fastening member, 64) and this provides considerably better stability to the clasp against rotation about an axis approximately coincidental with that of the clothesline, 7, than if this jaw element, 73, was shaped with a protrusion which contacted the hook, 53, at a generally fixed point. Such stability is provided in the same manner and for the same reason as explained above with reference to the device shown in FIGS. 19–21. There could be considerable departure from the radial orientation of the fastening members as depicted in FIG. 23 and the clasp would still function in substantially the same manner. However, the term "radial orientation" is used herein to distinguish this clasp from clasps having circumferentially oriented fastening members, presented later herein, which operate in a different manner.

In the embodiment of FIGS. 22–24, outstanding lateral stability is provided for the clasp by having the branches, 65, of the bifurcated fastening member, 64, long enough to accomodate the hook, 53, in two locations, at 75 and 76, where the hook passes between these branches; one location, 75, being inboard and the other location, 76, being outboard of the linear member, 7. If long enough to accomodate the hook only at the inboard location, 75, the clasp would be susceptable to being upset under the influences of adverse forces. Other clasps having a bifurcated fastening member in the form of a pair of coacting fastening hooks and an opposing clamping member with only one jaw element, as in the embodiments shown in FIGS. 1 through 9, are susceptible to being turned upside down in their fastening position, although they will continue to fasten a garment hanger hook to a clothesline in that position. The clasp shown in FIGS. 19 through 21, having a lateral hook containment structure, 51, operates on the same principle to stabilize the fastening position of that clasp as the clasp shown in FIGS. 22 through 24 which has a radially oriented bifurcated fastening member with branches long enough to accomodate the hook in the two locations mentioned above. Such a radially oriented bifurcated fastening member is, in fact, a form of lateral hook containment structure. FIG. 24 is a plan view of the bifurcated fastening member and the lever member with which it is combined showning the length of the two spaced-apart branches, 65, and the jaw element, 71, on each branch for clasping the clothesline or other linear member. Each of these jaw elements, 71, of the bifurcated fastening member is formed as a depression in the surface of the fastening member, as shown in FIG. 23, for constraining the linear member in maintaining its proper relative position in the bifurcated fastening member with respect to its distance from the location, at 68, where the two lever members are hingedly connected together. Each of the two lever members, 66 and 67, of the clasp have structures, 77, which are positioned as handles which can be squeezed together by hand to cause the two fastening members, together with their jaw elements, to open with respect to each other.

To use this openable clasp to fasten a garment hanger hook to a clothesline, the hook is first suspended from the clothesline in the normal manner. Then the handles, 72, are squeezed together to open the fastening members and their respective jaw elements and the clasp is moved so that the hook, 53, enters the space between the two spaced-apart branches of the bifurcated fastening member and the clothesline, 7, is positioned in the depressions which form the jaw elements, 71, of that fastening member. Then the clasp is released so that the jaw element, 73, on the second fastening member, 72, clamps to the outer surface of the garment hanger hook, 53, while the jaw elements, 71, on the bifurcated fastening member clamp to the undersurface of the clothesline, 7, with the result that the hook and the clothesline are directly and frictionally clamped together as shown in FIGS. 22 and 23.

The arrangement of the second fastening member of the openable clasp can be modified to change the location and manner in which it contacts the outer surface of the garment hanger hook. FIG. 25 shows a modification in which the second fastening member, 79, has two jaw elements, 80 and 81, which are positioned for contacting the outer surface of the hook, 53, in two separated locations, at 80 and 81, along the hook. One of these locations, at 80, is inboard and the other location, at 81, is outboard of the position occupied by the clothesline, 7, or other linear member. This arrangement adds some stability to the openable clasp in its fastening position and it also provides a means tending to restrain the clasp from shifting position so as to slip off the end (at 53) of the hanger hook when the hook has a section near its end which is straightened out or has less curvature than the curved upper section of the hook, as in the example of FIG. 25. This restraining action occurs because, as the outboard jaw element, 81, moves closer to the end of the hook, it is caused to ride up on the straightened-out portion of the hook which causes the two fastening members and their respective jaw elements to open wider against the force of the spring, 68. The reaction to this jaw-opening action is a force which tends to urge the jaws of the clasp in a direction away from the end of the hook. The opposing clamping member with two separated jaw elements used in the device shown in FIGS. 10-14, operates in the same manner to restrain the clasp from slipping off the end of the garment hanger hook.

FIG. 26 shows a modification of the openable clasp in which the bifurcated fastening member, 83, in addition to contacting the undersurface of the clothesline, 7, also contacts the outer surface of the garment hanger hook, 53, at a location on the hook which is inboard of the position occupied by the clothesline, 7. This is accomplished by shaping and positioning the bifurcated fastening member so that that fastening member contacts the hook at the inboard or closed end of the bifurcation (at 84). The second fastening member, 85, has a jaw element, 86, positioned for contacting the outer surface of the garment hanger hook, 53, at a location on the hook which is outboard of the position occupied by the clothesline, 7. This arrangement produces results which are very similar to those described with reference to the device shown in FIG. 25.

The lever members of the openable clasp may be provided with guide structure as shown in FIGS. 27 and 28. The purpose of the guide structure is to form a guide which allows relative movement of the two fastening members with respect to each other in opening and closing the clasp, but which restricts relative sideways displacement of the two fastening members and their respective jaw elements. This guide structure, 88, is structure which is connected to one of the lever members, in this case to the lever member, 66, which is combined with the bifurcated fastening member, 64, and which has surface which overlaps and lies next to at least a portion of a range of positions of surface on the other lever member (at 89) during opening and closing movement of the fastening members. Thus this guide structure forms a guide which accomplishes its stated purpose.

FIGS. 27 and 28 also show linear member retaining structure, 90, which has been added to one of the fastening members, in this case to the bifurcated fastening member, 64, just inboard of the position occupied by the clothesline, 7, when the clasp is in its fastening position. The purpose of this linear member retaining structure, 90, is to prevent relative movement of the clothesline with respect to the clasp in at least one direction away from its intended position in the clasp. In this case the linear member retaining structure, 90, is arranged to prevent relative movement of the clothesline in a direction toward the location, at 68, where the two lever members are hingedly connected together. In the embodiment shown in FIGS. 27 and 28, this linear member retaining structure, 90, is incorporated in and combined with the guide structure, 88. It should be noted that the placing of the jaw elements, 71, in a depression in the surface of the bifurcated fastening member, 64, of the clasp shown in FIGS. 22 through 24 is another form of linear member retaining structure which functions to prevent relative movement of the clothesline in both directions away from its intended position in the clasp. The clasp shown in FIGS. 27 and 28 also has such a depression, 71, for this purpose. Linear member retaining structure, when combined with the bifurcated fastening member, can be defined as structure which is located generally just to one side of the position occupied by the clothesline or other linear member as it passes transversely through the jaw region of the clasp when the clasp is in its fastening position and structure which extends above the level of that part of the jaw elements which contact the undersurface of the linear member for blocking relative movement of the linear member in at least one direction away from its intended position in the clasp, past the position where the linear member retaining structure is located.

The openable clasp can be provided with linear member retaining structure which is combined with the second fastening member of the clasp as shown in the device depicted in FIGS. 29 through 37. In this case, the linear member retaining structure, 92, is combined with the second fastening member, 93, and is located just outboard of the position occupied by the clothesline, 7, when the clasp is in its fastening position. Linear member retaining structure, when combined with the second fastening member, can be defined as structure which is located generally just to one side of the position occupied by the linear member when the clasp is in its fastening position and structure which extends generally toward the bifurcated fastening member a sufficient distance to effectively close the gap between the two fastening members to movement of the linear member in at least one direction away from its intended position in the clasp, past the position where the linear member retaining structure is located, when the clasp is in its closed fastening position.

In the clasp shown in FIGS. 29 through 37, the bifurcated fastening member 94, has branches which are long enough to accomodate the garment hanger hook, 2, generally in only one location, at 95, where the hook passes between the branches. When the bifurcated fastening member is not long enough to accomodate the hook in two locations (as it is in the devices shown in FIGS. 22-28), lateral stability can be provided by incorporating a lateral confinement element, 96, in the second fastening member, 93, in this case colocated with the single jaw element, 97, and positioned outboard of the position occupied by the clothesline, 7, when the clasp is in its fastening position. This lateral confinement element, 96, is shaped to accomodate and laterally confine the hook, 2, and, together with the confinement for the hook provided by the inboard end, 98, of the space between the two branches of the bifurcated fastening member, 94, it constitutes a form of lateral hook containment structure which provides stability against having the clasp become laterally upset in its fastening position on the hook and the clothesline.

The bifurcated fastening element, 94, in this clasp, in addition to having jaw elements, 99, which contact the undersurface of the clothesline, 7, also is shaped so that it contacts the outer surface of the garment hanger hook, 2, at the inboard end of the bifurcation on that fastening member, at 98. This clasp is constructed as two separate lever members combined with their respective fastening members, mechanically connected together by a hinge pivot, 62, and having a spring, 63, for biasing the fastening members toward a closed position.

An openable clasp with a radially oriented bifurcated fastening member can be made entirely of wire. An example of such construction is shown in FIGS. 38 through 41. Here each of the two lever members, together with its combined fastening member, is a discrete part of the clasp, made of a separate piece of wire. The resilient closing member is a spring comprised of two coils of wire, 102, formed from the terminal ends of the wire making one of the lever members. The ends of the wire of the other lever member are connected together as shown in FIGS. 40 and 41 to form a pivot which runs through the spring coils, 102, to provide for the hinged-type angular relative movement between the lever members. A tangential extension, 103, from the end of each spring coil, 102, hooks to the other lever member to connect the two lever members together and provide for the closing bias of the clasp. This clasp is arranged so that it can be opened by squeezing the sections extending from the pivot location together with the hand.

The bifurcated fastening member, 104, in this clasp is made from a single piece of wire and is formed by having the wire enter the structure of the bifurcated fastening member, at 105, arriving generally and approximately from the location, at 102, where the lever members are hingedly connected together, and then continuing generally to the end of one branch, 106, of the bifurcated fastening member, 104. Then the wire is bent in generally a reverse direction, at 107, so as to proceed generally to the closed end, 108, of the space between the branches of the bifurcated fastening member while remaining on one side of the position occupied by the hook, 2, when the clasp is in its fastening position. Then the wire is bent generally across to the other side of the position occupied by the hook so as to form the closed end, 108, of the space between the branches, after which the wire is bent in a similar, mirror-image manner on the other side of the position occupied by the hook, and finally exiting the structure of the bifurcated fastening member, at 109, to proceed generally back toward the location, at 102, where the lever members are hingedly connected together.

The bifurcated fastening member in the clasp shown in FIGS. 38 through 41 has a linear member retaining structure, 110, in the form of an upturned end of each branch of the bifurcated fastening member and located outboard of the position occupied by the clothesline, 7, or other linear member. The second fastening member, 111, has linear member retaining structure, 112, in the form of the crossover element, 112, which enables the clasp to be opened by the squeezing sections of it together as mentioned above. This linear member retaining structure, 112, is located inboard of the position occupied by the clothesline, 7. Thus the two linear member retaining structures, 110 and 112, one on each fastening member and located, respectively, outboard and inboard of the position occupied by the clothesline, 7, function, together, to retain the clothesline in its proper position in the clasp.

The second fastening member, 111, has a single jaw element, 113, which contacts the outer surface of the hook, 2, at a location which is outboard of the position occupied by the linear member, 7. As is evident from FIGS. 38 and 39, this second fastening member, 111, also incorporates a lateral confinement element with the jaw element, 113, to constrain the hook, 2, from being displaced sideways out of the jaw. This is especially desirable in this embodiment because the bifurcated fastening member, 104, is only long enough to accomodate the hook, 2, in one location, at 114, where the hook passes through the space between its branches. This lateral confinement element, 113, together with the lateral confinement provided for the hook by the inboard end of the bifurcated fastening member, 114, provides a lateral hook containment structure for the clasp to prevent the clasp from being laterally upset in its fastening position. It should be noted that the bifurcated fastening member, 104, in this clasp, in addition to contacting the undersurface of the clothesline, 7, also contacts the outer surface of the hook, 2, at the inboard and closed end, at 114, of the space between the branches of the bifurcated fastening member.

It may be desirable to have a lateral confinement element combined with the second fastening member of the openable clasp even when the bifurcated fastening member is long enough to accommodate the garment hanger hook in two locations where the hook passes through the space between its branches, as in the case of the embodiments shown in FIGS. 22 through 28. A reason for this is that a lateral confinement element can act to center a hook within the space between the branches which could be desirable when the clasp is used with hooks which are considerably thinner than the maximum hook thickness which the bifurcated fastening member is capable of accomodating.

Figure 42:
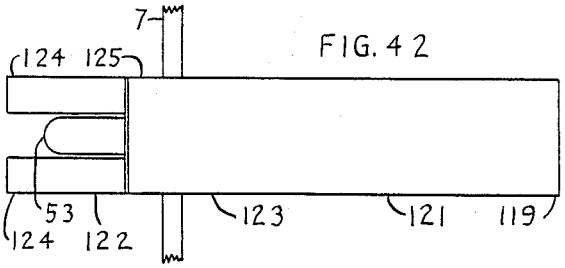
FIG. 42 is a plan view of the two-lever-member openable clasp made of a single piece of sheet metal, shown fastening a garment hanger hook to a clothesline.
Figure 43:
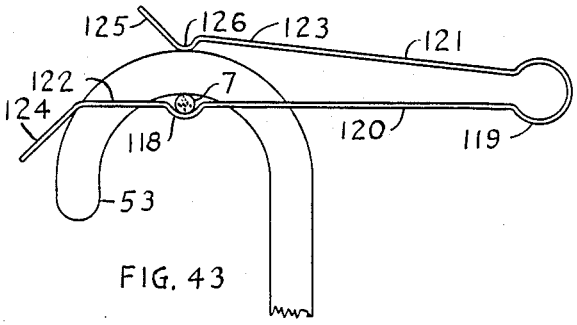
FIG. 43 is a side elevational view of the openable clasp shown in FIG. 42.

It was shown above, with reference to FIGS. 16 through 21, that the openable clasp can be constructed of a single piece of materaial when the bifurcated fastening member is in the form of a pair of coacting fastening hooks. Clasps having other forms of bifurcated fastening members can also be constructed as single-piece devices. FIGS. 42 and 43 show a clasp constructed of a single piece of sheet material which has a radially oriented bifurcated fastening member, 122, long enough to accomodate the garment hanger hook, 53, in two locations where the hook passes through the spaced-apart branches. In this clasp, the spring, 119, which urges the two fastening members toward a generally closed clasping position, also serves to connect the two lever members, 120 and 121, together to provide for the generally hinged-type angular relative movement between the lever members. This clasp does not have handles positioned so that the clasp can be opened by squeezing sections of it together. Instead, this clasp is configured to be pushed into its fastening position on the hook, 53, and the linear member, 7, by having its two fastening members, 122 and 123, arranged so that they will be opened sufficiently by contact with the hook and the linear member to permit such installation. In this embodiment, both the bifurcated fastening member, 122, and the second fastening member, 123, have ramped entry structure, 124 and 125 respectively, which is a section at the end of each fastening member angled outward toward the opening direction of the fastening member in order to facilitate opening of the fastening members by contact with the hook and the linear member when the clasp is forcefully pushed into its fastening position. Actually this device would work just about as well if only the bifurcated fastening member had ramped entry structure. In fact, such ramped entry structure would not be required on the bifurcated fastening member, 122, either if the branches of that fastening member extended outward sufficiently far from the jaw element, 126, of the second fastening member, 123, to allow those branches to be positioned below the linear member, 7, before pushing the clasp into its fastening position. It may be noted that this clasp has linear member retaining structure in the form of a depression, 118, in the surface of the bifurcated fastening member which forms the jaw elements for that fastening member.

Figure 44:
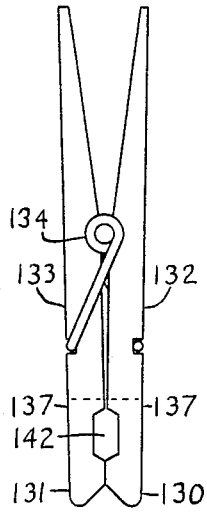
FIG. 44 is a side elevational view of the two-lever-member openable clasp wherein both fastening members are bifurcated to accommodate a section of the hook and having an enclosing aperture to receive the linear member.
Figure 45:
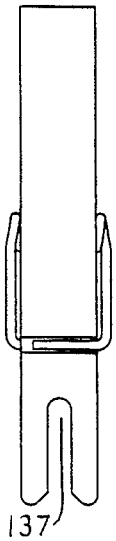
FIG. 45 is a view representing either of the devices shown in FIGS. 44 or 46 when rotated 90 degrees about their vertical axes.

An openable clasp in which both fastening members, 130 and 131, are bifurcated is shown in FIGS. 44 and 45. In this embodiment, the bifurcation in both fastening members is positioned in a primarily radial orientation with respect to a circle centered on an axis through the location, 134, where the two lever members, 132 and 133, are hingedly connected together. In this embodiment, each lever member, 132 and 133, is a discrete element to the extent that it is a separate entity from the other lever member and the connection, 134, between the lever members (also serving as the spring) is a mechanically hinged-type connection of the same type as used in the common spring clothespin. This clasp is opened and manipulated in the same manner as a spring clothespin.

Figure 46:
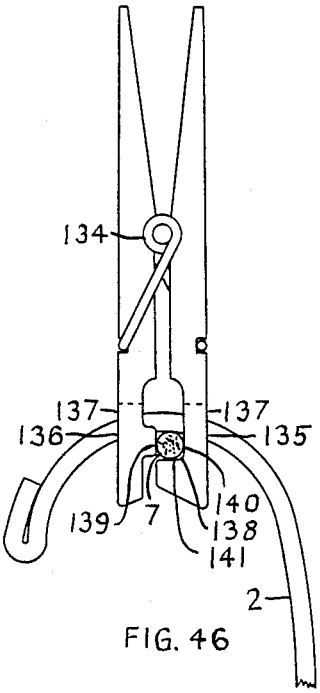
FIG. 46 is a side elevational view of the two-lever-member openable clasp wherein both fastening members are bifurcated to accommodate a section of the hook and having an "L" shaped internal surface in each of the jaw elements of one fastening member, shown fastening a garment hanger hook to a clothesline.

FIG. 46 shows a somewhat similar embodiment of the clasp to that shown in FIG. 44 in that both fastening members, 135 and 136, are also radially bifurcated. FIG. 45 serves as a 90-degree rotated view of the device in FIG. 44 and also of the device in FIG. 46 and it shows the extent of the bifurcation in both fastening members. The general manner in which both of these clasps function to fasten a hook to a linear member is shown in FIG. 46. Basically these clasps act to clamp or constrain the clothesline, 7, or other linear member between the jaw elements of the respective fastening members while the garment hanger hook, 2, is confined within the inner portion of the space, 137, between the branches of each of the two bifurcated fastening members. In the clasp shown in FIG. 46, a first one of the bifurcated fastening members, 135, has a pair of jaw elements, 138, (one on each branch) which have internal surfaces generally in the shape of an "L" which enables that fastening member, 135, to clasp the linear member, 7, at the side, 140, of the "L", while the bottom line of the "L", 141, holds and prevents the linear member from being displaced endwise out of the jaw elements. The second bifurcated fastening member, 136, has a pair of jaw elements, 139, which are shaped so that they contact the linear member, 7, only at the side of the jaw elements, at 139, to apply a pinching force to the linear member in conjunction with the clamping action of the first bifurcated fastening member. In this particular example, the jaw elements, 139, on the second bifurcated fastening member, 136, are mounted on a projection which protrudes into and fits inside of the other pair of jaw elements, 138, when the jaws are fully closed. This allows the clasp to grasp thinner clotheslines than would otherwise be possible. Thus it can be seen that, in the clasp shown in FIG. 46, the two bifurcated fastening members clamp the linear member, 7, between them, the first bifurcated fastening member, 135, holding it from being displaced endwise out of the clasp, while the hook, 2, is contained and locked within the inner part of the space, 137, between the two branches of each of the two bifurcated fastening members.

The clasp shown in FIG. 44 functions in the same general way except that the jaw elements of its bifurcated fastening members, 130 and 131, when closed, form a generally and at least partially enclosing aperture, 142, to receive the linear member and to hold it confiningly.

The openable clasp can have a bifurcated fastening member which is positioned in a primarily circumferential (or tangential) orientation, instead of being radially oriented as is characteristic of the clasps shown in FIGS. 22 through 46. A clasp having two circumferentially oriented bifurcated fastening members is shown in FIGS. 47 through 50. The term "circumferential" as used herein to describe the positioning and orientation of a bifurcated fastening member means that the effective clasping portion of the fastening member lies approximately in a circumferential or tangential direction in the clasp with respect to a circle centered on an axis through the location where the two lever members are hingedly connected together, with such effective clasping portion facing toward the interior region of the clasp. Thus, with reference to FIG. 47, one of the bifurcated fastening members, 147, has a clasping portion or jaw element, 151, which runs approximately in a circumferential direction with respect to the hinge pivot, 154, which connects the two lever members, 149 and 150, together. This jaw element, 151, is positioned for contacting the undersurface of the clothesline, 7, or other linear member where it passes transversely through the jaw region of the clasp. This bifurcated fastening member, 147, is also arranged so that it contacts the outer surface of the garment hanger hook, 2, at the inner end of the space (at 153) between the two branches of that bifurcated fastening member, 147. The second fastening member, 148, is also bifurcated and circumferentially oriented in the clasp and it, too, is arranged so that it contacts the outer surface of the hook, 2, at the inner end of the space (at 156) between its two branches.

Figure 47:
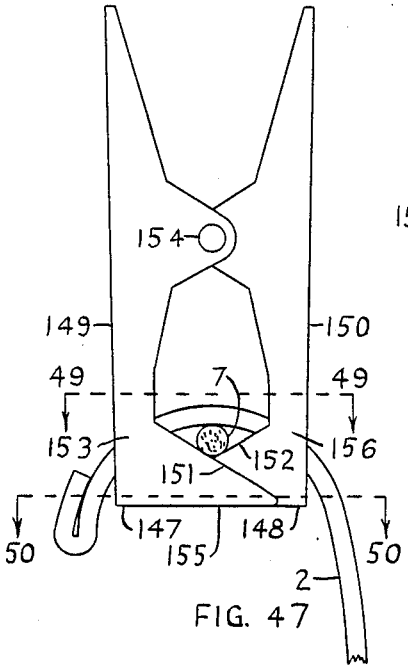
FIG. 47 is a side elevational view of the two-lever-member openable clasp having a circumferentially oriented bifurcated fastening member, shown fastening a garment hanger hook to a clothesline.
Figure 48:
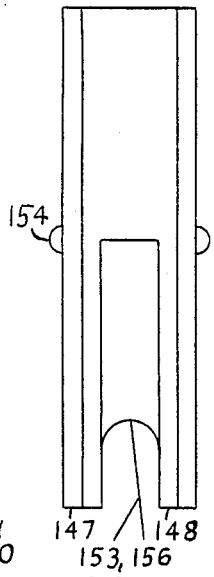
FIG. 48 is a view of the openable clasp shown in FIG. 47 when rotated 90 degrees about its vertical axis, shown without the garment hanger hook and the clothesline.
Figure 49:
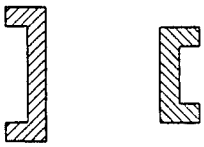
FIG. 49 is a view of the section at the plane indicated by the line 49—49 of FIG. 47.
Figure 50:
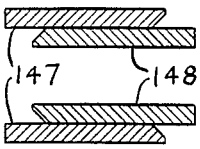
FIG. 50 is a view of the section at the plane indicated by the line 50—50 of FIG. 47.

In the embodiment depicted in FIGS. 47 and 48, the jaw elements, 151 and 152, of the bifurcated fastening members, 147 and 148, are oriented at an acute angle to the exact circumferential direction at the location of those jaw elements such that the jaw elements effectively form an inclined ramp in which the further inboard from the end of each jaw element a surface point on that jaw element is located, the closer it is to the hinge pivot, 154, which connects the two lever members together. Thus, as the linear member, 7, is pushed further inboard along these inclined ramp surfaces by the closing action of the jaws, it will be forced to a position closer to the hinge pivot. At the same time, the reaction of the curved upper surfaces of the hook, 2, to the closing action of the two fastening members, will be to force the hook to a position farther away from the hinge pivot. The combined result of these two reactions is to clamp the hook and the linear member together.

It is not necessary that both fastening members be circumferentially oriented in the clasp. For example, it would be sufficient if only the first mentioned bifurcated fastening member, 147, was circumferentially oriented. The second fastening member, 148, could, in such a case, have a radially oriented bifurcation arranged such that, in closing, it would push the linear member, 7, further inboard along the inclined ramp surfaces of the jaw element, 151, of the first mentioned bifurcated fastening member, 147. This would provide for substantially the same type of fastening action as in the case where both bifurcated fastening members are circumferentially oriented. This clasp, with either one or both fastening members having circumferentially oriented inclined ramp surfaces, can be used to fasten two generally linear members together in a generally crossing relationship.

When the clasp is used for fastening a hook to a linear member, these inclined ramp surfaces generally provide for the accommodation of a greater range of different sizes of hanger hooks and clothesline diameters than would be the case if the angle of inclination of these surfaces was zero. However, this clasp would still work for this purpose if this angle of inclination was zero, i.e., if the surfaces of these jaw elements were parallel to the bottom or outboard surfaces, 155, of the fastening members. This is so because the curved upper surface of the hook, 2, also acts as a pair of opposite-facing inclined ramp surfaces which causes the clasp to "ride" up on these surfaces as the two fastening members close due to the urging of the resilient closing member (not shown). When this happens, the circumferentially oriented jaw elements are raised along with the rest of the clasp causing the clothesline, 7, to be pulled up and pressed against the hook, 2, thereby clamping the hook and the linear member together. When the clasp is configured to operate in this manner, it is not necessary that the second fastening member, 148, have any bifurcation at all. All that is necessary for the second fastening member under such circumstances is that it contact the curved upper surface of the garment hanger hook, 2, in order to react with such surface to raise the clasp as explained above. It may be desirable, when the clasp is configured and used in such manner, for the jaw elements of the circumferentially oriented bifurcated fastening member to have a raised section which extends above the contacting surface of those elements (toward the hinge pivot, 154), to serve as a barrier or fence for retaining the linear member from unwantedly slipping off those jaw elements. Such a raised section would be comparable to the linear member retaining structure present in the clasps depicted in FIGS. 22 through 43, and generally such a raised section would be located at the end of those jaw elements, 151.

It is not necessary that the fastening members be arranged so that the location where they contact the outer surface of the hook (at 153 and 156) be raised to the level depicted in FIG. 48. Particularly in the case where the angle of inclination of the contacting surfaces on the jaw elements is zero (when these surfaces are parallel to the bottom or outboard surfaces, 155, of the fastening member, as mentioned above), the clasp will function properly if the location where the fastening members contact the outer surface of the hook, at 153 and 156, is approximately at the same level as the contacting surfaces on the jaw elements. However, it is desirable that any fastening member which is not bifurcated have a lateral confinement element so as to confine the hook from being displaced sideways out of that fastening member. This, together with the bifurcated fastening member, will comprise a lateral hook containment structure to provide lateral stability to the clasp in its fastening position.

Most of the embodiments of the openable clasp presented herein can be used to fasten either a hook to a linear member or two generally linear members together. The foregoing is considered as illustrative only of the principles of the invention. Further, since numerous modifications and changes will readily occur to those skilled in the art, it is not intended to limit the invention to the exact construction and operation described, and accordingly, all suitable modifications and equivalents may be resorted to, falling within the scope of the invention as claimed.

What is claimed is:

1. A clasp for fastening a hook to a linear member when the hook is hooked to the linear member, the clasp comprising a bifurcated fastening member with two generally parallel spaced-apart branches for accomodating the hook within the space between the branches and a jaw element on each branch for contacting and clamping to the underside of the linear member; a second fastening member having a jaw element for contacting and clamping to the outer surface of the hook; lateral hook containment structure incorporated in at least one of the two fastening members for accomodating and laterally confining the hook in at least two effectively spaced-apart locations; relative movement connecting structure for connecting each of the two fastening members together so as to provide for limited relative opening-and-closing hook-and-linear-member clasping movement of the two fastening members with respect to each other; and a resilient closing member interposed, at least indirectly, between the two fastening members for generally urging the two fastening members toward a closed clasping position; wherein the two fastening members are mutually adapted to clamp to the outer surface of the hook and to the underside of the linear member to clamp the hook and the linear member together and to remain in a stable fastening position in fastening the hook and the linear member together; and wherein the clasp is arranged so that it can be directly installed to clamp the hook and the linear member together.

2. The clasp of claim 1 wherein the relative movement connecting structure is comprised of two lever members which are connected to provide for generally hinged-type angular relative movement between the lever members, said bifurcated fastening member being combined with a first one of the lever members and said second fastening member being combined with a second lever member to provide for the relative opening-and-closing movement of the two fastening members with respect to each other.

3. The clasp of claim 2 wherein said bifurcated fastening member is positioned in a primarily radial orientation with respect to a circle centered on an axis through the location where the two lever members are, at least in effect, hingedly connected together, with the two branches of said bifurcated fastening member being separated from each other in a direction generally parallel to the axis of said circle

4. The clasp of claim 2 wherein said bifurcated fastening member is positioned in a primarily circumferential orientation with respect to a circle centered on an axis through the location where the two lever members are, at least in effect, hingedly connected together, with the two branches of said bifurcated fastening member being separated from each other in a direction generally parallel to the axis of said circle.

5. The clasp of claim 1 wherein the bifurcated fastening member is comprised of a pair of spaced-apart coacting fastening hooks arranged for straddling and reaching past the hook being fastened to the linear member and hooking to and clampingly pulling the linear member toward and against the hook being fastened to the linear member and wherein the second fastening member is an opposing clamping member arranged for applying clamping pressure to the outer surface of the hook being fastened to the linear member.

6. The clasp of claim 1 wherein the two fastening members are slidably connected together through a sliding guide in the relative movement connecting structure to provide at least part of the relative movement connection between the two fastening members.

7. The clasp of claim 1 further comprising an overcenter locking lever which is interposed, at least indirectly, between the two fastening members and which has a separate and at least indirect pivotal connection with each of the two fastening members, the overcenter locking lever being adapted to impart relative movement of the two fastening members with respect to each other when manipulated to cause the clasp to open and close, and also to lock the clasp in the closed and fastening position.

8. The clasp of claim 1 wherein the lateral hook containment structure is incorporated in said bifurcated fastening member by having said fastening member shaped so that it accomodates and laterally confines the hook in at least two effectively spaced-apart locations.

9. The clasp of claim 1 wherein the lateral hook containment structure is comprised of at least one lateral confinement element on said second fastening member together with at least one laterally hook confining element on one of the two fastening members, wherein said two elements are shaped and positioned so that they accomodate and laterally confine the hook in at least two effectively spaced-apart locations.

10. The clasp of claim 1 further comprising linear member retaining structure combined with at least one of the two fastening members for preventing relative movement of the linear member in at least one direction away from its intended position in the clasp past the position where the linear member retaining structure is located when the clasp is in its closed fastening position.

11. A connecting device generally capable of connecting an object to a generally linear member, said connecting device comprising the combination of a hook and a discrete openable clasp for fastening the hook to the linear member, wherein there is means for attaching the object, at least indirectly and at least temporarily, to the hook, normally to the non-hooked or shank portion of the hook, wherein the clasp comprises a bifurcated fastening member with two generally parallel spaced-apart branches for accomodating the hook within the space between the branches and a jaw element on each branch for contacting and clamping to the underside of the linear member; a second fastening member having a jaw element for contacting and clamping to the outer surface of the hook; relative movement connecting structure for connecting each of the two fastening members together so as to provide for limited relative opening-and-closing hook-and-linear-member clasping movement of the two fastening members with respect to each other; and a resilient closing member interposed, at least indirectly, between the two fastening members for generally urging the two fastening members toward a closed clasping position; wherein the two fastening members are mutually adapted to clamp to the outer surface of the hook and to the underside of the linear member to clamp the hook and the linear member together and to remain in a stable fastening position in fastening the hook and the linear member together; wherein the clasp is arranged so that it can be directly installed to clasp the hook and the linear member together; and wherein the installed position and assembled configuration of said connecting device is one in which the object, when it is being connected to the linear member, is attached to the hook by means mentioned above the hook is hooked to the linear member in the normal manner, and the clasp is positioned with respect to the hook and the linear member such that at least part of the hook is accomodated within the space between the two spaced-apart branches of said bifurcated fastening member, the linear member passes transversely through the jaw region of the clasp with the jaw elements of said bifurcated fastening member clasping to the linear member, and said second fastening member clasps the hook and the linear member together in conjunction with the clasping action of said bifurcated fastening member.

12. The connecting device of claim 11 wherein the hook is the hook part of a garment hanger and the object is the remaining part of the same garment hanger.

13. The connecting device of claim 11 wherein the bifurcated fastening member of the clasp has lateral hook containment structure which accomodates the hook in at least two effectively spaced-apart locations where the hook passes through the space between its two branches.

14. The openable clasp as included in claim 11 wherein the bifurcated fastening member of the clasp has lateral hook containment structure which accomodates the hook in at least two effectively spaced-apart locations where the hook passes through the space between its two branches.

15. The clasp as included in claim 13 wherein one such location where the hook passes through the space between the branches of the bifurcated fastening member is on one side, and the other such location is on the other side of the position occupied by the linear member when the clasp is in its described fastening position.

16. The openable clasp as included in claim 11 wherein the clasp is effectively constructed of a single contoured piece of sheet material formed into the shape of the clasp, wherein said bifurcated fastening member is formed as a result of a cut-out section of the piece of sheet material, and wherein the resilient closing member is a section of the piece of sheet material situated between the two fastening members.

17. The openable clasp of claim 16 further comprising a lateral hook containment structure which accomodates the hook in at least two effectively spaced-apart locations.

18. The openable clasp of claim 16 wherein the resilient closing member is, in functional effect, a two-legged spring.

19. The connecting device of claim 11 wherein said bifurcated fastening member of the clasp is comprised of a pair of spaced-apart coacting fastening hooks arranged for straddling and reaching past the hook being fastened to the linear member and hooking to and clampingly pulling the linear member toward and against the hook being fastened to the linear member and wherein said second fastening member is an opposing clamping member arranged for applying clamping pressure to the outer surface of the hook being fastened to the linear member.

20. The connecting device of claim 19 wherein each of the two coacting fastening hooks of the clasp is generally J-shaped with a generally linear shank extending away from the hooked part of the hook and wherein the opposing clamping member is slidably connected to each hook shank, so as to provide for at least part of the opening-and-closing hook-and-linear-member clasping movement of the two fastening members with respect to each other.

21. The openable clasp as included in claim 19 wherein each of the two coacting fastening hooks is generally J-shaped with a generally linear shank extending away from the hooked part of the hook and wherein the opposing clamping member is slidably connected to each hook shank, so as to provide for at least part of the opening-and-closing hook-and-linear-member clasping movement of the two fastening members with respect to each other.

22. The openable clasp as included in claim 20 wherein the resilient closing member is a spring and wherein both fastening members of the clasp are made of, and are parts of, the same continuous piece of material of which the spring is made.

23. The openable clasp of claim 22 wherein the clasp is made of wire.

24. The openable clasp of claim 23 wherein the clasp is constructed so that each end of a piece of wire of which the clasp is made effectively terminates at the end of each coacting fastening hook, the wire being bent between each of its two ends to form the clasp.

25. The openable clasp as included in claim 20 wherein the shanks of the coacting fastening hooks are curved and positioned so that the opening and closing movement of the opposing clamping member with respect to the coacting fastening hooks will be approximately along the direction of the curvature of the shanks of the hooks.

26. The connecting device of claim 19 wherein the opposing clamping member of the clasp has one jaw element which is positioned for contacting the outer surface of the hook being fastened to the linear member in substantially one location.

27. The connecting device of claim 19 wherein the opposing clamping member of the clasp effectively has two jaw elements which are positioned for contacting the outer surface of the hook being fastened to the linear member in two respective locations which are effectively spaced apart from each other, one location being inboard and the other location being outboard of the position occupied by the linear member when the clasp is in its fastening position.

28. The openable clasp as included in claim 19 wherein the opposing clamping member has a lateral confinement element for restraining the hook being fastened to the linear member from being displaced sideways out of a jaw element, said lateral confinement element normally being incorporated in a jaw element.

29. The openable clasp of claim 28 wherein the opposing clamping member has at least two lateral confinement elements positioned at sufficiently spaced-apart locations to stabilize the clasp against being upset in its fastening position on the hook and the linear member, such lateral confinement elements together comprising a lateral hook containment structure.

30. The openable clasp as included in claim 19 wherein the bifurcated fastening member of the clasp has lateral hook containment structure which is shaped and positioned so that it accomodates the hook being fastened to the linear member in at least two effectively spaced-apart locations where the hook passes through the space between its two branches, one such location being inboard and the other such location being outboard of the position occupied by the linear member when the clasp is in its described fastening position, whereby the clasp is provided with improved stability in its fastening position.

31. The openable clasp as included in claim 19 further comprising lateral hook containment structure which accomodates and laterally confines the hook being fastened to the linear member in at least two effectively spaced-apart locations where the hook passes through the lateral hook containment structure and wherein the resilient closing member is a generally two-legged spring with one leg connected at least indirectly to a coacting fastening hook and the other leg connected at least indirectly to the opposing clamping member.

32. The openable clasp of claim 31 wherein the lateral hook containment structure is incorporated in the bifurcated fastening member by having that member shaped and positioned so that it accomodates the hook being fastened to the linear member in at least two effectively spaced-apart locations where the hook passes through the space between its two branches.

33. The openable clasp as included in claim 19 wherein the resilient closing member is a generally compression-type helical spring acting in the direction of the opening-and-closing movement of the two fastening members with respect to each other.

34. The connecting device of claim 11 further comprising an overcenter locking lever which is interposed between the two fastening members of the clasp and which has a separate and at least indirect pivotal connection with each of the two fastening members of the clasp, the overcenter locking lever being adapted to impart relative movement of the two fastening members with respect to each other when manipulated to cause the clasp to open and close, and also to lock the clasp in the closed position.

35. The openable clasp as included in claim 34 further comprising a lateral hook containment structure which is adapted to accomodate and laterally confine the hook being fastened to the linear member in at least two effectively spaced-apart locations where the hook passes through the lateral hook containment structure.

36. The openable clasp as included in claim 19 further comprising an overcenter locking lever which is interposed between the two fastening members of the clasp and which has a separate and at least indirect pivotal connection with each of the two fastening members of the clasp, the overcenter locking lever being adapted to impart relative movement of the two fastening members with respect to each other when manipulated to cause the clasp to open and close, and also to lock the clasp in the closed position.

37. The openable clasp of claim 36 wherein the resilient closing member is effectively interposed between one of the pivotal connections on the overcenter locking lever and that fastening member which is at least indirectly connected to said one of the pivotal connections, the other pivotal connection of the overcenter locking lever being at least indirectly connected to the other fastening member, the interposition being such that the resilient closing member generally causes the clasp to apply a sustained clamping force to the hook and the linear member when the clasp is in its fastening position and the overcenter locking lever is in its closed and locking position.

38. The openable clasp of claim 37 wherein each of the two coacting fastening hooks is generally J-shaped with a generally linear shank extending away from the hooked part of the hook; wherein the opposing clamping member is slidably connected to the shanks of the coacting fastening hooks so that it can slide back and forth along the shanks during opening and closing of the clasp; wherein the two coacting fastening hooks are effectively and at least indirectly connected together by a hook connecting structure which is sufficiently sturdy in its construction and connection with the two coacting fastening hooks to maintain an approximately fixed relative position of the two coacting hooks with respect to each other throughout the normal range of operation of the clasp; wherein one pivotal connection for the overcenter locking lever is effectively and at least indirectly connected to the two coacting fastening hooks, such connection ordinarily being made to the hook connecting structure, the other pivotal connection for the overcenter locking lever being connected at least indirectly to the opposing clamping member; and wherein the resilient closing member is a spring so interposed between a pivotal connection on the overcenter locking lever and one of the fastening members that the spring is at least part of the connecting link between the overcenter locking lever and that fastening member, causing the opposing clamping member to slide back and forth along the shanks of the coacting fastening hooks to open and close the clasp when the overcenter locking lever is moved through its range of movement.

39. The openable clasp of claim 37 wherein the resilient closing member is a spring effectively interposed between a pivotal connection for the overcenter locking lever and a coacting fastening hook.

40. The openable clasp of claim 37 wherein the resilient closing member is a spring effectively interposed between a pivotal connection for the overcenter locking lever and the opposing clamping member.

41. The openable clasp of claim 37 wherein the resilient closing member is a multi-legged spring having at least two legs and lying substantially in a plane.

42. The openable clasp of claim 37 wherein the opposing clamping member has two jaw elements which are positioned for contacting the outer surface of the hook being fastened to the linear member in each of two effectively spaced-apart locations, one such location being inboard and the other such location being outboard of the position occupied by the linear member when the clamp is in its prescribed fastening position, and wherein there is a lateral hook confinement element at each jaw element shaped so that, together, these two confinement elements comprise a lateral hook containment structure.

43. The connecting device of claim 11 wherein the relative movement connecting structure of the openable clasp is comprised of two lever members which are connected together to provide for generally hinged-type angular relative movement between said lever members, said bifurcated fastening member being combined with a first one of the lever members and said second fastening member being combined with a second one of the lever members to provide for the relative opening-and-closing hook-and-linear-member clasping movement of the two fastening members with respect to each other.

44. The openable clasp as included in claim 43 wherein said bifurcated fastening member of the clasp has lateral hook containment structure which is shaped and positioned so that it accomodates the hook in at least two effectively spaced-apart locations where the hook passes through the space between its two branches, whereby the clasp is provided with improved stability in its fastening position.

45. The connecting device of claim 43 wherein said bifurcated fastening member of the openable clasp is positioned in a primarily radial orientation with respect to a circle centered on an axis through the location where the two lever members are, in effect, hingedly connected together with the two branches of said bifurcated fastening member being separated from each other in a direction generally parallel to the axis of said circle, wherein the jaw elements on said bifurcated fastening member are positioned for contacting and applying clamping pressure to the linear member with the linear member passing transversely through the jaw region of the clasp, the clamping direction of said jaw elements on the linear member being primarily circumferential with respect to said defined circle, wherein said second fastening member does not have a bifurcation positioned in a primarily radial orientation in the clasp with branches capable of accomodating the hook between them and wherein the jaw element of said second fastening member is positioned for contacting the outer surface of the hook being fastened to the linear member and for applying clamping pressure thereon in a direction in general opposition to the clamping action of the jaw elements of said bifurcated fastening member on the linear member, whereby the fastening position of the clasp with respect to the hook and the linear member is that in which at least part of the hook is positioned between the two branches of said bifurcated fastening member, the jaw elements of said bifurcated fastening member contact and clasp the undersurface of the linear member where it passes transversely through the clamp, the jaw element on said second fastening member contacts and clasps the outer surface of the hook in at least one location so that the two fastening members conjointly clasp the hook and the linear member together, and the location where the two lever members are, in effect, hingedly connected together is generally positioned to one side of the hook.

46. The openable clasp as included in claim 45 wherein said bifurcated fastening member is made of a single piece of wire and wherein said bifurcated fastening member is constructed by having the wire formed so as to enter the structure of said bifurcated fastening member by arriving generally and approximately from, and in a direction leading away from, the location where the two lever members are, in effect, hingedly connected together, and then continuing generally to the end of one branch of said bifurcated fastening member while remaining generally on one side of the position occupied by the hook when the clasp is in its described fastening position, then being bent in a generally reverse direction so as to proceed generally to the closed end of the space between the branches of said bifurcated fastening member while continuing to remain on the same side of said position occupied by the hook, then being bent generally across to the other side of said position occupied by the hook so as to form said closed end of the space between said branches, the wire then being bent in a similar, mirror-image, manner on said other side of said position occupied by the hook and, finally, exiting the structure of said bifurcated fastening member by proceeding generally and approximately toward said location where the two lever mmebers are, in effect, hingedly connected together.

47. The connecting device of claim 45 wherein the two lever members of the openable clasp have structures which are positioned as handles which can be squeezed together by hand to cause the respective fastening members, together with the jaw elements thereon, to open with respect to each other.

48. The openable clasp as included in claim 45 wherein at least one of the two fastening members has ramped entry structure which generally comprises a section at the end of said fastening member which is angled outward toward the opening direction of said fastening member.

49. The connecting device of claim 45 wherein each lever member of the clasp is a discrete entity from the other lever member, and wherein the connection between the lever members is substantially in the nature of a mechanically hinged-type connection.

50. The openable clasp of claim 58 wherein the resilient closing member is a generally coil-type spring with its axis located along the pivot of the hinged-type connection between the two lever members, wherein said spring has a generally tangential extension at each end of the coil, each such extension being further bent at the end of the tangential part of the extension in a generally right angle bend so that each terminal end of the wire of the spring is approximately parallel to the axis of the spring and situated at a radial distance from the coiled part of the spring, and wherein the spring forms the hinge pivot for the lever members by having the spring and the spring-attachment portion of the lever members shaped and assembled in a manner similar to the common spring clothespin.

51. The openable clasp as included in claim 45 wherein both of the two lever members of the clasp, together with their respective fastening members, are made of the same continuous piece of material and wherein the resilient closing member is a spring which is formed of the same continuous piece of material of which the two lever members are made and wherein said spring provides the connection between the two lever members which allows the hinged-type angular relative movement between the lever members.

52. The connecting device of claim 45 wherein said second fastening member of the openable clasp is shaped and positioned for contacting the outer surface of the hook with its jaw element effectively in only one general location of contact which is about the same distance away from the location where the two lever members are connected together as the position occupied by the linear member when the clasp is in its described fastening position on the hook and the linear member.

53. The connecting device of claim 45 wherein said second fastening member of the clasp has jaw elements which are shaped and positioned for contacting the outer surface of the hook in two effectively separated locations along the hook.

54. The connecting device of claim 45 wherein said second fastening member of the clasp has a jaw element which is shaped and positioned for contacting the outer surface of the hook at a location on the hook which is outboard of the position occupied by the linear member when the clasp is in its described fastening position on the hook and the linear member, such location being with reference to the clasp.

55. The openable clasp as included in claim 45 wherein said second fastening member has a jaw element which is shaped and positioned for contacting the outer surface of the hook at a location on the hook which is inboard of the position occupied by the linear member when the clasp is in its described fastening position on the hook and the linear member, such location being with reference to the clasp.

56. The openable clasp as included in claim 45 wherein said bifurcated fastening member is shaped and positioned for contacting the outer surface of the hook at a location on the hook which is inboard of the position occupied by the linear member when the clasp is in its described fastening position on the hook and the linear member, such location being with reference to the clasp and ordinarily being at the inboard end of the bifurcation on said fastening member.

57. The connecting device of claim 38 wherein the jaw elements of said bifurcated fastening member of the openable clasp are formed as a depression in the surface of said fastening member for constraining the linear member in maintaining its relative position in said fastening member.

58. The connecting device of claim 45 further comprising linear member retaining structure which is combined with said bifurcated fastening member and located generally just to one side of the position occupied by the linear member as it passes transversely through the jaw region of the clasp when the clasp is in its described fastening position, said linear member retaining structure being structure which extends above the level of that part of the jaw elements which contact the undersurface of the linear member for blocking relative movement of the linear member in at least one direction away from its intended position in the clasp with respect to its distance from the location where the two lever members are, in effect, hingedly connected together, past the position where the linear member retaining structure is located.

59. The openable clasp as included in claim 45 further comprising linear member retaining structure which is combined with said second fastening member and located generally just to one side of the position occupied by the linear member as it passes transversely through the jaw region of the clasp when the clasp is in its described fastening position, said linear member retaining structure being structure which extends generally toward said bifurcated fastening member a sufficient distance to effectively close the gap between the two fastening members to movement of the linear member in at least one direction away from its intended position in the clasp with respect to its distance from the location where the two lever members are, in effect, hingedly connected together, past the position where the linear member retaining structure is located, when the clasp is in its closed fastening position.

60. The device device of claim 45 further comprising guide structure combined with one of the lever members of the openable clasp, generally at a radial distance from the location where the two lever members are, in effect, hingedly connected together, said guide structure having surface which overlaps and lies next to at least a portion of a range of positions of surface on the other lever member during the opening and closing movement of the two fastening members in order to form a guide which allows relative movement of the fastening members in opening and closing but which restricts relative sideways displacement of the two fastening members.

61. The connecting device of claim 45 wherein said bifurcated fastening member of the clasp is of sufficient length to accomodate the hook in only one location where said hook passes through the space between the two branches of said bifurcated fastening member, said location being inboard of the position occupied by the linear member when the clasp is in its described fastening position and wherein said second fastening member has a lateral hook confinement element located outboard of the position occupied by the linear member so as to comprise, together with said bifurcated fastening member, an effective lateral hook containment structure for the clasp.

62. The connecting device of claim 45 wherein said bifurcated fastening member of the clasp is of sufficient length to accomodate the hook in two effectively spaced-apart locations where the hook passes through the space between its two branches, one such location being inboard and the other such location being outboard of the position occupied by the linear member when the clasp is in its described fastening position, so as to comprise an effective lateral hook containment structure for the clasp.

63. The openable clasp as included in claim 45 wherein said bifurcated fastening member of the clasp is of sufficient length to accomodate the hook in two effectively spaced-apart locations where the hook passes through the space between its two branches, one such location being inboard and the other such location being outboard of the position occupied by the linear member when the clasp is in its described fastening position, so as to comprise an effective lateral hook containment structure for the clasp.

64. The connecting device of claim 62 further comprising linear member retaining structure combined with one fastening member of the clasp for constraining the linear member against relative movement in at least one direction away from its intended position in the clasp.

65. The openable clasp as included in claim 62 further comprising linear member retaining structure combined with one fastening member of the clasp for constraining the linear member against relative movement in at least one direction away from its intended position in the clasp.

66. The openable clasp as included in claim 45 further comprising a lateral confinement element incorporated in said second fastening member for laterally confining the hook within said second fastening member.

67. The openable clasp of claim 66 wherein said lateral confinement element is positioned and combined with other elements and members of the clasp so that said lateral confinement element comprises part of an effective lateral hook containment structure to provide lateral stability for the clasp when in its fastening position.

68. The connecting device of claim 43 wherein the openable clasp has a bifurcated fastening member which, together with its two spaced-apart branches, is positioned in a primarily circumferential orientation with respect to a circle centered on an axis through the location where the two lever members are, in effect, hingedly connected together and which has a jaw element on each branch for contacting the undersurface of the linear member with the linear member passing transversely through the jaw region of the clasp, the contacting surface of said jaw elements facing toward the interior region of the clasp, generally toward a location near to where the two lever members are hingedly connected together, wherein said circumferentially oriented bifurcated fastening member also has a surface for contacting the outer surface of the hook, such surface generally being at the inboard end of the bifurcation on said fastening member; wherein the outer fastening member has a contacting surface for contacting the outer surface of the hook; and wherein, in the fastening position and assembled configuration of said device, the openable clasp is positioned with respect to the hook and the linear member such that the jaw elements of said circumferentially oriented bifurcated fastening member contact and apply clamping pressure to the undersurface of the linear member while at least part of the hook is accomodated within the space between the two branches of said fastening member and, also, while said fastening member contacts and applies clamping pressure to the outer surface of the hook, and the other fastening member contacts and applies clamping pressure to the outer surface of the hook, with the generally hinged-type connection between the lever members being located generally above the hook.

69. The openable clasp as included in claim 68 wherein the two fastening members are shaped so that, together, they comprise a lateral hook containment structure to provide lateral stability for the clasp when in its fastening position.

70. The openable clasp of claim 69 wherein a circumferentially oriented bifurcated fastening member which has jaw elements which face toward the interior region of the clasp for contacting the undersurface of the linear member where it passes transversely through the jaw region of the clasp, has a raised section on said jaw elements which extends above the contacting surface of said jaw elements for serving as a barrier for retaining the linear member from unwantedly slipping off said jaw elements.

71. The openable clasp of claim 69 wherein a circumferentially oriented bifurcated fastening member which has jaw elements which face toward the interior region of the clasp for contacting the undersurface of the linear member where it passes transversely through the jaw region of the clasp, has the contacting surfaces of said jaw elements oriented at an acute angle to the exact circumferential direction at the location of such contacting surfaces in the clasp, such that such contacting surfaces effectively form inclined ramps in which the further inboard from the end of a jaw element a surface point is located, the closer it is to the generally hinged-type connection between the lever members, and wherein the other fastening member is bifurcated for accomodating a section of the hook within the space between its two branches and said other fastening member has jaw elements for contacting and urging the linear member inboard along the inclined ramps of said jaw elements which have said ramps, whereby the closing of the two fastening members and their jaw elements will cause a linear member passing transversely through the jaw region of the clasp to be urged inward toward the interior region of the clasp and therby to be clampingly forced against the hook when the clasp is in its described fastening position.

72. A connecting device generally capable of connecting an object to a generally linear member, said device comprising the combination of a hook and a discrete openable clasp for fastening the hook to the linear member, wherein there is means for attaching the object, at least indirectly and at least temporarily, to the hook, generally to the non-hooked or shank portion of the hook, wherein the openable clasp comprises a bifurcated fastening member with two generally parallel spaced-apart branches for accomodating the hook within the space between the two branches and a jaw element on each branch for clasping the linear member; a second fastening member, having a jaw element, for generally clasping the hook and the linear member together in conjunction with the clasping action of said bifurcated fastening member; relative movement connecting structure for connecting each of the two fastening members together so as to provide for limited relative opening-and-closing hook-and-linear-member clasping movement of the two fastening members with respect to each other; and a resilient closing member interposed, at least indirectly, between the two fastening members for generally urging the two fastening members toward a generally closed hook-and-linear-member clasping position; wherein at least one of the fastening members has linear member retaining structure for positively (as distinguished from frictionally) preventing the movement of the linear member off the end of the fastening members when the clasp is in its closed hook-and-linear-member clasping position; wherein the installed position and assembled configuration of said device is one in which the object, when it is being connected to the linear member, is attached to the hook by means mentioned above, the hook is hooked to the linear member in the normal manner, and the clasp is positioned with respect to the hook and the linear member such that at least part of the hook is accomodated within the space between the two spaced-apart branches of said bifurcated fastening member, the linear member passes transversely through the jaw region of the clasp with the jaw elements of said bifurcated fastening member clasping the linear member, and said second fastening member generally clasps the hook and the linear member together in conjunction with the clasping action of said bifurcated fastening member.

73. The connecting device of claim 72 wherein the relative movement connecting structure of the openable clasp is comprised of two lever members connected together so as to provide for generally hinged-type angular relative movement between the lever members, said bifurcated fastening member being combined with a first lever member and said second fastening member being combined with a second lever member to provide for the relative opening-and-closing movement of the two fastening members with respect to each other, wherein said second fastening member of the clasp is bifurcated with two generally parallel spaced-apart branches for accomodating the hook within the space between its two branches, wherein each of the two bifurcated fastening members is positioned in a primarily radial orientation with respect to a circle centered on an axis through the location where the two lever members are, in effect, hingedly connected together, and wherein, in the installed position and assembled configuration of the device, both bifurcated fastening members accomodate a section of the hook within the space between their two branches.

74. The openable clasp as included in claim 73 wherein each lever member is a discrete element of the clasp to the extent that it is a separate entity from the other lever member, and wherein the connection between the lever members is a mechanically hinged-type connection.

75. The openable clasp as included in claim 73 wherein the resilient closing member is a generally coil-type spring with its axis located along the pivot of the hinged-type connection between the two lever members, wherein said coil-type spring has a generally tangential extension at each end of the coil, each such extension being further bent at the end of the tangential part of the extension in a generally right angle bend so that each terminal end of the wire of the spring is approximately parallel to the axis of the spring and situated at a radial distance from the coiled part of the spring, and wherein the spring forms the hinge pivot for the lever members by having the spring and the spring-attachment portion of the lever members shaped and assembled in a manner similar to the common spring clothespin.

76. The connecting device of claim 73 wherein the jaw elements of the openable clasp, when closed, form a generally and at least partially enclosing aperture to receive the linear member and to hold it confiningly.

77. The openable clasp as included in claim 73 wherein one of the two bifurcated fastening members has a pair of jaw elements which have internal surfaces generally and somewhat in the shape of an "L" in a view of the clasp in which the generally angular relative movement between the two lever members occurs and lies in the plane of the image, the vertical line of the "L" being generally and approximately parallel to a radial extending from the location where the lever members are connected together to that part of the jaw elements occupied by the linear member, and the bottom line of the "L" being generally and approximately perpendicular to said radial, said bottom line being that part of the "L" which is at the greatest distance from said location where the two lever members are connected together, said jaw elements thereby being configured to contact the linear member generally at the side and at the end of the internal part of said jaw elements; and wherein the other bifurcated fastening member has a pair of jaw elements which are shaped so that they contact the linear member generally only at the side of the jaw elements; the jaw elements of both bifurcated fastening members thereby acting together to apply a pinching force to the linear member between them, respectively, while that part of the first mentioned pair of jaw elements corresponding to the bottom line of the "L" holds and prevents the linear member from being displaced endwise out of the jaw elements.

78. The openable clasp of claim 77 wherein the pair of jaw elements which are shaped so that they contact the linear member generally only at the side of the jaw elements, have the surface which so contacts the linear member mounted on a projection which protrudes into and fits inside of the other pair of jaw elements when the jaws are fully closed.

79. A method for fastening a hook to a generally linear member to which the hook is hooked in the normal manner comprising putting a resiliently biased openable clasp having a bifurcated jawed fastening member, a second jawed fastening member and means for positively and forcefully clamping the hook to the linear member, into a fastening position with respect to the hook and the linear member such that said bifurcated jawed fastening member accomodates the hook within the space between its two branches and its jaw elements clasp the linear member with the linear member passing transversely through the jaw region of the clasp, and a jaw element of said second jawed fastening member generally clasps the hook and the linear member together in conjunction with the clasping action of said bifurcated jawed fastening member.

80. A method for connecting an object to a generally linear member comprising the steps of attaching the object to the hook, generally to the non hooked or shank portion of the hook, hooking the hook to the linear member in the normal manner, and fastening the hook to the linear member by means of an openable clasp as set forth in claim 79.

81. A method according to claim 79 wherein said bifurcated jawed fastening member is a pair of coacting fastening hooks arranged for straddling and reaching past the hook being fastened to the linear member and hooking to and clampingly pulling the linear member inward, and said second jawed fastening member is an opposing clamping member arranged for applying clamping pressure to the outer surface of the hook being fastened to the linear member in opposition to the clamping action of the coacting fastening hooks on the linear member, and wherein, in performing the method, the openable clasp is manipulated to move the coacting fastening hooks into a position of straddling and reaching past the hook being fastened to the linear member and of hooking to the linear member, and to move the opposing clamping member into a position of contacting the outer surface of the hook being fastened to the linear member, and the openable clasp is released so that the coacting fastening hooks and the opposing clamping member conjointly clamp the hook and the linear member together.

82. A method according to claim 81 wherein the resiliently biased openable clasp is arranged for opening the jawed fastening members with respect to each other by pressing sections of the clasp together with the hand and wherein, in performing the method, the jawed fastening members are first opened by hand and then the openable clasp is put into and released in the described fastening position.

83. A method according to claim 81 wherein the openable clasp has an overcenter locking lever interposed between, and having a separate and at least indirect pivotal connection with, the pair of coacting fastening hooks and the opposing clamping member, respectively, such that movement of the overcenter locking lever opens, closes, and locks the openable clasp in the closed position, and wherein, in performing the method, the opened openable clasp is moved into its described position with respect to the hook and the linear member, and then closed and locked in a closed fastening position by moving the overcenter locking lever, said clasp being released in that position.

84. A method for fastening two generally linear members together in a generally crossing relationship according to the method of claim 81 for fastening a hook to a generally linear member as applied to two linear members arranged in a crossing relationship wherein, in performing the method, the openable clasp is manipulated to move the coacting fastening hooks into a position of straddling and reaching past the generally linear member which is closest to the installing side of the clasp and of hooking to the other generally linear member which is on the far side of said closest linear member, and to move the opposing clamping member into a position of contacting the closest surface of said closest linear member, and the clasp is released so that the coacting fastening hooks pull the far generally linear member inward and against the closest generally linear member while the opposing clamping member pushes outward on the closest generally linear member in opposition to the pulling action of the coacting fastening hooks, thereby fastening the two crossing generally linear members together.

85. A method according to claim 84 wherein the openable clasp has an overcenter locking lever interposed between, and having a separate and at least indirect pivotal connection with, the pair of coacting fastening hooks and the opposing clamping member, respectively, such that movement of the overcenter locking lever opens, closes, and locks the clasp in the closed position, and wherein, in performing the method, the opened openable clasp is moved into its described fastening position with respect to the two crossing linear members being fastened together, and then closed and locked in a closed fastening position by moving the overcenter locking lever, said clasp being released in that position.

86. A method according to claim 79 wherein the openable clasp has two hingedly connected lever members which are angularly movable with respect to each other, one jawed fastening member being combined with each lever member to provide for the openability of the clasp, and wherein, in performing the method, the openable clasp is manipulated so that its two jawed fastening members open with respect to each other and so that the clasp is put into the fastening position set forth therein.

87. A method for fastening two generally linear members together in a generally crossing relationship according to the method of claim 86 for fastening a hook to a linear member as applied to two linear members arranged in a crossing relationship wherein, in performing the method, the openable clasp is put into a position with respect to the two crossing linear members such that the linear member closest to the installing side of the clasp is accomodated within the space between the two branches of said bifurcated jawed fastening member and the other linear member is accomodated and held in a transverse relationship to, and by the conjoint fastening action of, the two jawed fastening members, thereby fastening the two linear members together in a generally crossing relationship.

88. A method according to claim 86 wherein said bifurcated jawed fastening member is substantially radially oriented in the openable clasp, wherein said second jawed fastening member is not effectively radially bifurcated, and wherein the method, as restated in greater detail, comprises putting the clasp into a position with respect to the hook and the linear member such that said bifurcated jawed fastening member accomodates the hook within the space between its two branches and its jaw elements bear up on the undersurface of the linear member, and the jaw element of said second jawed fastening member bears down on the outer surface of the hook, the method being accomplished by moving the clasp into said position from a position generally to one side of the hook and the linear member, with the substantially radial direction of said bifurcated jawed fastening member generally pointing toward the hook and the linear member, thereby clamping the hook and the linear member together.

89. A method according to claim 88 wherein the two angularly movable lever members of the openable clasp have structures connected to them which are shaped and positioned so that they can be squeezed together by hand to open the clasp and wherein the method includes the act of opening the jawed fastening members of the clasp by squeezing such structures together before putting the clasp into the therein described position with respect to the hook and the linear member.

90. A method according to claim 88 wherein the jawed fastening members of the openable clasp are shaped so that the clasp can be opened by contact of the jawed fastening members with the hook and the linear member and wherein, in performing the method, the clasp is pushed with sufficient force into the fastening position described therein to cause the jawed fastening members to open sufficiently by contact with the hook and the linear member to allow the clasp to be moved into said fastening position.

91. A method according to claim 86 wherein the bifurcated jawed fastening member is substantially circumferentially oriented in the openable clasp, it has jaw elements for contacting and clasping the linear member which face toward the interior region of the clasp, and it also has a contacting surface for contacting the outer surface of the hook, generally at the inboard end of the bifurcation, and the second jawed fastening member has a contacting surface for contacting the outer surface of the hook and wherein the method, as restated in greater detail, comprises putting the clasp into a position with respect to the hook and the linear member such that said circumferentially oriented bifurcated fastening member accomodates a section of the hook within the space between its two branches and it contacts and bears down on the outer surface of the hook while the jaw elements on its two branches bear up on the undersurface of the linear member, and said second jawed fastening member contacts and bears down on the outer surface of the hook, thereby clamping the hook and the linear member together.

92. A method for fastening two generally linear members together in a generally crossing relationship according to the method of claim 91 for fastening a hook to a generally linear member as applied to two linear members arranged in a crossing relationship, wherein the contacting surfaces on the jaw elements on circumferentially oriented bifurcated fastening member are shaped and oriented to form inclined ramp surfaces such that a linear member which is accomodated in a generally transverse position in those jaw elements is urged in a direction toward the interior region of the clasp as it moves further inboard from the end of said jaw elements on said circumferentially oriented bifurcated fastening member, wherein the second jawed fastening member is bifurcated and has jaw elements for urging the linear member inboard along the inclined ramp surfaces on said jaw elements on said circumferentially oriented bifurcated fastening member, and wherein, in performing the method, the openable clasp is put into a position with respect to the two crossing linear members such that the linear member closest to the installing side of the clasp is accomodated within the space between the two branches of each bifurcated fastening member and the other linear member is contacted by and urged inboard along the inclined ramp surfaces of the jaw elements of said circumferentially oriented bifurcated fastening member by the jaw elements on the second bifurcated jawed fastening member, said other linear member consequently being urged toward the closest linear member while the closest linear member is constrained from moving toward the interior region of the clasp by contacting surfaces on each bifurcated fastening member, generally at the inboard end of each bifurcation, the result thereby being that a clamping force is applied to the two crossing linear members to clamp them together.

93. A method for providing the openable clasp as included in claim 11 with improved stability in its position of fastening a hook to a generally linear member comprising the step of providing said bifurcated fastening member of the clasp with a lateral hook containment structure shaped so that it accomodates the hook in at least two effectively spaced-apart locations where the hook passes through the space between its two branches.

94. A method for providing improved stability and for the retention of the openable clasp, as included in claim 11, when the clasp is in its installed position and assembled configuration with respect to the hook and the linear member, the method comprising the steps of providing the clasp with lateral hook containment structure and of providing the clasp with linear member retaining structure.

95. A method for providing the openable clasp, as included in claim 11, with improved stability in its position of fastening a hook to a generally linear member, the method comprising the step of providing the clasp with lateral hook containment structure.

96. A method for providing the openable clasp, as included in claim 11, with improved retention in its installed position with respect to the hook and the linear member, the method comprising the step of providing the clasp with linear member retaining structure for retaining the linear member in its position with respect to the jaw elements of the clasp.

* * * * *